US009947988B2

(12) United States Patent
Takashima et al.

(10) Patent No.: US 9,947,988 B2
(45) Date of Patent: Apr. 17, 2018

(54) WIRELESS COMMUNICATION DEVICE WITH INTEGRATED FERRITE SHIELD AND ANTENNA, AND METHODS OF MANUFACTURING THE SAME

(71) Applicant: Thin Film Electronics ASA, Oslo (NO)

(72) Inventors: Mao Takashima, Cupertino, CA (US); Aditi Chandra, Los Gatos, CA (US); Somnath Mukherjee, Milpitas, CA (US); Gloria Wong, Mountain View, CA (US); Khanh Van Tu, Oslo (NO); Joey Li, Milpitas, CA (US); Anton Popiolek, Oslo (NO); Arvind Kamath, Los Altos, CA (US)

(73) Assignee: Thin Film Electronics ASA, Oslo (NO)

( * ) Notice: Subject to any disclaimer, the term of this patent is extended or adjusted under 35 U.S.C. 154(b) by 0 days.

(21) Appl. No.: 15/230,348

(22) Filed: Aug. 5, 2016

(65) Prior Publication Data

US 2017/0040665 A1 Feb. 9, 2017

Related U.S. Application Data

(60) Provisional application No. 62/202,130, filed on Aug. 6, 2015.

(51) Int. Cl.

| | |
|---|---|
| ***H01Q 1/24*** | (2006.01) |
| ***H01Q 1/22*** | (2006.01) |
| ***H01Q 7/06*** | (2006.01) |

(52) U.S. Cl.

CPC ..... *H01Q 1/2291* (2013.01); *H01Q 7/06* (2013.01)

(58) Field of Classification Search

CPC ..... H01Q 1/24; H01Q 7/06

(Continued)

(56) References Cited

U.S. PATENT DOCUMENTS 3,447,143 A * 5/1969 Hair ..... G11C 11/20 333/238

7,973,722 B1 7/2011 Hill et al.

(Continued)

OTHER PUBLICATIONS

Michael Gebhart et al.; "Design of 13.56 MHz Smartcard Stickers With Ferrite for Payment and Authentication"; 6 pages; NXP Semiconductors, Gratkom, Austria and Hamburg, Germany.

(Continued)

*Primary Examiner* — Huedung Mancuso

(74) *Attorney, Agent, or Firm* — Andrew D. Fortney; Central California IP Group, P.C.

(57) ABSTRACT

A wireless communication device and methods of manufacturing and using the same are disclosed. The wireless communication device includes a substrate with an antenna and/or inductor thereon, a patterned ferrite layer overlapping the antenna and/or inductor, and a capacitor electrically connected to the antenna and/or inductor. The wireless communication device may further include an integrated circuit including a receiver configured to convert a first wireless signal to an electric signal and a transmitter configured to generate a second wireless signal, the antenna being configured to receive the first wireless signal and transmit or broadcast the second wireless signal. The patterned ferrite layer advantageously mitigates the deleterious effect of metal objects in proximity to a reader and/or transponder magnetically coupled to the antenna.

20 Claims, 8 Drawing Sheets

(58) Field of Classification Search
USPC ..... 343/702
See application file for complete search history.

(56) References Cited

U.S. PATENT DOCUMENTS

| | | | | |
|---|---|---|---|---|
| 9,236,658 | B2 * | 1/2016 | Charrat | H01Q 7/005 |
| 9,336,475 | B2 * | 5/2016 | Takeoka | H01Q 1/2225 |
| 2005/0212707 | A1 * | 9/2005 | Egbert | G06K 19/07749 343/702 |
| 2007/0102663 | A1 | 5/2007 | Xiao et al. | |
| 2010/0124151 | A1 | 5/2010 | Someya | |
| 2011/0266883 | A1 * | 11/2011 | Eray | H01Q 7/00 307/104 |
| 2012/0086556 | A1 * | 4/2012 | Ikemoto | G06K 19/07749 340/10.1 |
| 2013/0234899 | A1 | 9/2013 | Pope et al. | |
| 2014/0104133 | A1 * | 4/2014 | Finn | G06K 19/07769 343/866 |

OTHER PUBLICATIONS

PCT International Search Report and Written Opinion; PCT International Searching Authority/US dated Oct. 21, 2016; International Patent Application No. PCT/US16/45909; 8 pages; International Searching Authority/United States, Commissioner for Patents; Alexandria, Virginia.

* cited by examiner

FIG. 6

| Material | Estimated u' | t (um) | w/Cu sheet (in mm) |
|---|---|---|---|
| Air | 1 | | 0.0 |
| Plastic | 1 | 880 | 0.1 |
| Ferrite #1 | 5-10 | 100 | 0.0 |
| | | 130 | 2.5 |
| | | 200 | 5.0 |
| | | 350 | 10.0 |
| Ferrite #2 | 5-10 | 120 | 5.0 |
| | | 100 | 0.1 |
| | | 220 | 5.0 |
| | | 200 | 10.0 |
| | | 300 | 15.0 |
| Iron | <5 | 100 | 0.0 |
| | | 133 | 2.5 |
| | | 400 | 5.0 |
| Ferrite #3 | 5-10 | 220 | 5 |
| | | 310-350 | 7.5-10 |
| | | 400 | 12.5 |
| | | 670 | 22.5 |
| | | 750 | 30 |
| Ferrite #4 | 5-10 | 280-300 | 7.5-10 |
| Ferrite #5 | 20 | 300 | 25 |
| Ferrite #6 | 20 | 320 | 27.5 |
| Ferrite #7 | 20-25 | 250 | 20 |
| Ferrite #8 | 10-15 | 480 | 22 |
| Ferrite #9 | 10 | 320 | 12.5 |
| Silicon Steel | 15-20 | 150 | 12.5 |
| Silicon Steel | 15-20 | 150 | 11 |

WIRELESS COMMUNICATION DEVICE WITH INTEGRATED FERRITE SHIELD AND ANTENNA, AND METHODS OF MANUFACTURING THE SAME

CROSS REFERENCE TO RELATED APPLICATION

This application claims the benefit of U.S. Provisional Patent Application No. 62/202,130, filed on Aug. 6, 2015, incorporated herein by reference as if fully set forth herein.

FIELD OF THE INVENTION

The present invention generally relates to the field of wireless devices and/or wireless communication. More specifically, embodiments of the present invention pertain to wireless devices, such as sensors, near field communication (NFC), high frequency (HF), very high frequency (VHF), radio frequency (RF), Bluetooth, Zigbee, and electronic article surveillance (EAS) tags and devices with an integrated ferrite shield and antenna, and methods of manufacturing and using the same. The present invention may provide a low-cost process for producing wireless devices (and especially devices with limited read ranges, such as NFC, RF and EAS tags) with improved read range, signal strength and/or signal integrity.

DISCUSSION OF THE BACKGROUND

Wireless tags and readers operating in the high frequency (HF) and the very-high frequency (VHF) systems and/or communicating using magnetic coupling or magnetically coupled transponders (e.g., near field communication [NFC] devices) may suffer performance degradation when placed on or near metal objects due to detuning or reflection of the wireless signal. As a result, relatively poor tag read ranges, phantom reads, and/or no reads occur. For example, NFC and other antennae operating at similar frequencies (~13 MHz) are effectively unusable if placed on a conductive substrate. However, there is a wide range of uses for devices using these frequencies, such as RF/NFC tags placed on aluminum foil in blister packs.

Conventional solutions to overcome metal detuning for HF and other wireless tags include adding a large spacer or gap between the wireless tag and metal object, or inserting an EMI (electromagnetic interference) shield between the tag and metal object in applications where low profiles are desired. The spacer or gap (e.g., a spacer of non-conducting and/or non-magnetic material) may be positioned between the metal surface and the tag. However, spacers are not often desirable, available or permitted, due to space constraints.

Conventional EMI shields are typically made of ferrite or silicon steel laminate films (50-300 μm). Although conventional ferrite EMI shields may be effective in counteracting the effect of nearby metal objects on tags, conventional ferrite shielding is relatively expensive, especially for relatively large antennas. In addition, conventional ferrite thin films may be brittle, with limited flexibility. Furthermore, conventional ferrite thin films generally cannot be applied to products with small radii (e.g., an AA or AAA battery).

Generally, a conventional EMI silicon steel shield is made of a blanket laminate film having an adhesive backing, which is subsequently applied to the back of an antenna. The EMI shield must be large enough to overlap all traces and/or loops of the antenna for maximum shielding effect. However, when applied to regions that do not need to be shielded, using a conventional EMI silicon steel shield with a blanket laminate film may waste raw silicon steel shield material, which typically makes up the largest portion of the total shield cost.

As a practical matter, the raw material for shielding is limited, as low cost solutions (approximately a few cents) must be used for fabricating wireless tags and devices that can be read on metal surfaces. Furthermore, patterning or cutting conventionally available EMI laminate films is not practical or cost effective, as the removed material is not easy to recycle or recover cost-effectively. Consequently, conventional EMI films may be too costly to be accepted widely for wireless (e.g., NFC and RF) tags for inexpensive products. In addition, conventional EMI films may have physical and/or structural limitations, due to their brittleness and limited flexibility.

Since conventional EMI films (e.g., ferrite shields) generally add cost to the tags and/or products to which the tags are attached, and can introduce implementation issues in some cases, a low cost solution to counteract and/or mitigate the effect of metal on or in proximity to magnetically coupled near field communication devices is desired.

This "Discussion of the Background" section is provided for background information only. The statements in this "Discussion of the Background" are not an admission that the subject matter disclosed in this "Discussion of the Background" section constitutes prior art to the present disclosure, and no part of this "Discussion of the Background" section may be used as an admission that any part of this application, including this "Discussion of the Background" section, constitutes prior art to the present disclosure.

SUMMARY OF THE INVENTION

Embodiments of the present invention relate to wireless tags and devices, such as sensors and NFC, HF, VHF, RF, RFID, Bluetooth, Zigbee, and EAS tags and devices, with an integrated ferrite shield and antenna, and methods of manufacturing and using the same.

In one aspect, the present invention relates to a wireless communication device, comprising a substrate with an antenna and/or inductor thereon, a patterned ferrite layer on the same or different substrate that overlaps the antenna and/or inductor, and a capacitor electrically connected to the antenna and/or inductor. The patterned ferrite layer (e.g., EMI shield) is configured to mitigate or counteract an electromagnetic effect of metal on or near a surface of the wireless device, and thus advantageously mitigates the deleterious effect of metal objects in proximity to a reader and/or transponder magnetically coupled to the antenna and/or inductor. The ferrite shield may alleviate or eliminate the effects of the underlying conductor. In various embodiments, the ferrite shield is placed between the conductor and the antenna. The present ferrite shield wholly or partially comprises a material with electro-magnetic shielding properties. Suitable materials generally include ferrites, although the invention is not limited thereto. For example, in addition to actual ferrites, the present ferrite shield may comprise an iron-based alloy having an electro-magnetic shielding property. In exemplary embodiments, the patterned ferrite layer comprises a soft ferrite (e.g., a magnetically soft ferrite).

In one embodiment, the wireless communication device comprises an EAS tag or device. In the presence of an oscillating wireless signal, the antenna and/or inductor is configured to generate or produce a current in the EAS tag or device sufficient for the tag or device to backscatter detectable electromagnetic (EM) radiation. Additionally, first and second capacitor plates are electrically connected to the antenna and/or inductor in the EAS tag or device. In other embodiments, the wireless communication device further comprises an integrated circuit. The integrated circuit comprises a receiver configured to convert a first wireless signal to an electrical signal, and a transmitter configured to generate a second wireless signal. The antenna and/or inductor is an antenna configured to receive the first wireless signal and transmit or broadcast the second wireless signal.

In various embodiments of the present invention, the substrate(s) may comprise a glass, a glass/polymer laminate, a high temperature polymer such as a polyimide or polycarbonate, a metal such as stainless steel or a metal foil, etc. In certain embodiments, the patterned ferrite layer is on the same substrate as the antenna, and in such a case, the substrate may comprise or consist of a flexible dielectric material.

In further embodiments of the present invention, the antenna and/or inductor may be on a first surface of the substrate and the ferrite layer is printed or otherwise formed in a pattern on a second surface of the same substrate. Alternatively, the antenna/inductor and the patterned ferrite layer may be on or over the same surface of the substrate, separated by one or more dielectric layers. In general, an area of the patterned ferrite layer overlaps at least 50% of an area of the antenna and/or inductor. In many embodiments, the area of the patterned ferrite layer overlaps at least 90% of the area of the antenna and/or inductor. In addition, the area of the patterned ferrite layer may be less than or equal to 200% of the area of the antenna and/or inductor. In some embodiments, the patterned ferrite layer has a pattern that is substantially identical to and/or defined by a pattern of the antenna and/or inductor (e.g., an outermost periphery, and optionally, an innermost periphery). Generally, the patterned ferrite layer or film has a thickness of 50 μm to 600 μm.

Additionally, the printed ferrite layer may be on a low-profile inlay (e.g., RFID or EAS tag) or a generic inlay. An inlay (or "smart label") generally includes an IC chip and an antenna, which is laminated and/or adhered to a label and encoded. In some embodiments of the present invention, the patterned ferrite film may be formed by printing a ferrite-containing ink or a ferrite-containing paste, or by extruding, stamping or otherwise forming the ferrite film in a pattern in a single step (e.g., from a hot-melt suspension or other formulation that is substantially in the solid phase at ambient temperatures).

Another aspect of the present invention relates to a composition, generally comprising a ferrite or a ferrite precursor, a polymer binder, and optionally a solvent in which the ferrite or ferrite precursor and polymer binder is soluble. Generally, the ferrite or ferrite precursor may comprise a soft ferrite (e.g., a magnetically soft ferrite) or soft ferrite precursor (e.g., a MnZn ferrite powder, a NiZn ferrite powder, silicon steel flakes, a mixture of Mn or Ni powder, Zn powder, and iron or iron (II) oxide powder, etc.), a hard ferrite or hard ferrite precursor (e.g., iron oxide particles, iron nanoparticles, a mixture of iron (III) oxide particles and other metal (II) oxide particles, etc.), or a combination of soft and hard ferrites and/or ferrite precursors. When a soft ferrite powder is used, the powder may have a dimension (e.g., particle size) of from 1 nm to 100 μm. For NFC devices, a soft ferrite such as MnZn ferrite powder is generally preferred.

Typically, the polymer binder comprises a polyethylene, a polyethylene copolymer, polyester, a polyacrylate, a polyurethane, a polyimide, a polytetrafluoroethylene, a polydimethylsiloxane, a poly(diethylenediamine), a polyalkylene oxide or other epoxide polymer such as poly(epichlorohydrin) or epoxycyclohexylethyl-trimethoxysilane, ethylene- or other alkylene-vinyl acetate copolymers, alkylene-styrene (e.g., styrene-ethylene/butylene-styrene [SEBS]) copolymers and blends, alkylene-(meth)acrylic acid and -(meth) acrylate (e.g., ethylene-acrylic acid) copolymers, butadiene-based polymers, and/or an isoprene-based polymer, or a polybisphenol such as polybisphenol A. In exemplary embodiments, the ferrite or ferrite precursor and the polymer binder may be present in a ratio by weight of from approximately 90:10 to 99:1 (ferrite/precursor to polymer binder). In some hot-melt embodiments, the ferrite or ferrite precursor and the polymer binder may be present in a ratio by weight of from about 50:50 to about 90:10, and in one example, approximately 75:25 (ferrite/precursor to polymer binder).

In various embodiments of the present invention, a solvent may be used in the formulation. Suitable solvents may include, for example, $C_3$-$C_6$ ketones (acetone, methyl ethyl ketone [MEK]), $C_6$-$C_{10}$ arenes, such as benzene, toluene, xylenes, or other arenes substituted with one to three $C_1$-$C_4$ substituent groups (e.g., mesitylene, phenylethane, 2-phenyl-2 methylpropane, etc.), $C_4$-$C_{10}$ ethers (e.g., diethyl ether, methyl t-butyl ether, etc.), $C_1$-$C_6$ esters of $C_1$-$C_6$ alkanoic acids (e.g., ethyl acetate), water, $C_1$-$C_4$ alcohols, mixtures thereof, etc., but the solvent is not necessarily limited thereto. The choice of solvent may depend on the type of polymer binder (e.g., its solubility in the solvent).

Yet another aspect of the present invention relates to a method of manufacturing a wireless communication device that generally comprises forming an antenna and/or inductor on a substrate, printing or forming a patterned ferrite layer on the same or different substrate, and electrically connecting an integrated circuit or resonant circuit component with the antenna and/or inductor. The patterned ferrite layer overlaps the antenna and/or inductor. The antenna/inductor is configured to (i) receive a first wireless signal and transmit or broadcast a second wireless signal, or (ii) generate or produce a current in the wireless communication device sufficient for the wireless communication device to backscatter detectable electromagnetic radiation in the presence of an oscillating wireless signal having a predetermined frequency. The method of manufacturing the device may further comprise forming a capacitor electrically connected to the antenna and/or inductor. In embodiments where the antenna/inductor is configured to receive and transmit or broadcast wireless signals, the antenna/inductor is an antenna coupled to a receiver configured to convert the first wireless signal to an electric signal and a transmitter configured to generate the second wireless signal. The antenna and/or inductor and the integrated circuit or resonant circuit component are on the same or different substrates. In certain embodiments, the patterned ferrite layer and the antenna and/or inductor are formed on the same substrate. In such embodiments further including an integrated circuit, the integrated circuit may be formed on a different substrate from the patterned ferrite layer and the antenna and/or inductor.

In various embodiments of the present method, forming the antenna and/or inductor may comprise depositing a first metal layer on the first surface of the substrate, and patterning and/or etching the first metal layer. Alternatively, forming the antenna and/or inductor may comprise printing a metal coil or ring on the substrate. Optionally, the metal coil or ring may be a seed layer for the antenna and/or inductor, and forming the antenna and/or inductor may further comprise electroplating or electrolessly plating a bulk metal on the seed layer. In further embodiments of the present method, forming the patterned ferrite layer comprises printing a ferrite-containing or ferrite precursor-containing ink or paste (e.g., on a dielectric layer over the antenna or on a second surface of the substrate). For example, forming or printing the patterned ferrite layer comprises printing the ink or paste containing the ferrite or the ferrite precursor on (i) a side of the substrate opposite from the antenna and/or inductor, or (ii) a same side of the substrate as the antenna and/or inductor. When the ink or paste is printed on the same side of the substrate as the antenna and/or inductor, a dielectric layer may be between the patterned ferrite layer and the antenna and/or inductor. Printing the ferrite film may further comprise drying the ferrite-containing ink, and curing and/or annealing a ferrite precursor in the dried ferrite-containing ink. Alternatively, the ferrite-containing or ferrite precursor-containing ink may be printed or formed in a pattern on the substrate, a dielectric layer is formed or deposited over the ferrite layer, and the antenna and/or inductor is formed (e.g., by printing) on the dielectric layer. In a further alternative, the ferrite ink can be printed on a third substrate having favorable transferability properties (e.g., silicone-treated paper), optionally covered with an adhesive, and transferred onto the antenna substrate (e.g., on the opposite side from the antenna, or over the antenna). In further alternative embodiments, forming the patterned ferrite layer may comprise extruding, printing or coating a composition containing the ferrite or ferrite precursor and the polymer binder. The composition may comprise or consist of components that are in the solid phase at ambient temperature (e.g., 25° C.).

The present invention advantageously provides a method for forming a patterned electromagnetic shield (e.g., a ferrite film) overlapping an antenna and/or inductor of a wireless device (e.g., an NFC, RF or EAS tag), which can counteract the electromagnetic effect(s) of nearby metal surfaces on the antenna and/or inductor. In addition, the present invention minimizes the cost of manufacturing ferrite shields for wireless communication devices by printing shielding material only where it is required (e.g., in locations of the antenna rings and/or loops), while still providing sufficient shielding, such that the tags may be read at a reasonable distance (e.g., 4-10 mm or more). Furthermore, the present invention eliminates the necessity of an additional adhesive for the ferrite shield, since the patterned or printed ferrite film adheres onto the antenna and/or inductor substrate directly. The present invention further advantageously provides ferrite-containing films that have sufficient flexibility for application onto products having relatively small radii.

Furthermore, the present ink for printing a ferrite-based electromagnetic shield advantageously enables low-cost prevention of external electromagnetic interference (EMI) and shielding of the device's internal magnetic fields. The application of EMI shielding may advantageously allow remote monitoring of products or devices having the present wireless (e.g., NFC, EAS or RF) tags thereon without interfering with product or device functionality. For example, when the product or device is a battery, the present tag can determine and communicate the battery power status. As a result, the present invention advantageously decreases the manufacturing cost of the ferrite shield as compared to conventional ferrite-based shields, improves the performance and/or efficiency of wireless communication devices relative to existing wireless devices, and reduces the amount of material used in comparison to existing ferrite shields. These and other advantages of the present invention will become readily apparent from the detailed description of various embodiments below.

BRIEF DESCRIPTION OF THE DRAWINGS

FIG. 6 is a table summarizing shielding data for a variety of different patterned ferrite shields according to the present invention.

DETAILED DESCRIPTION

Figure 1:
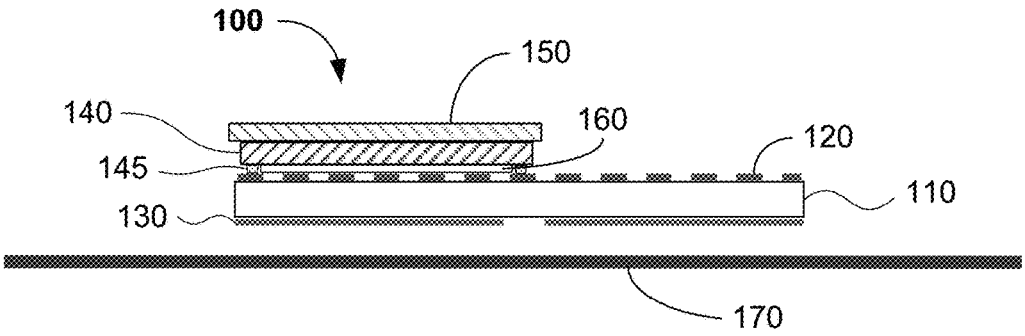
FIG. 1 is a cross-section of an exemplary integrated antenna and ferrite shield according to the present invention.

Reference will now be made in detail to various embodiments of the invention, examples of which are illustrated in the accompanying drawings. While the invention will be described in conjunction with the following embodiments, it will be understood that the descriptions are not intended to limit the invention to these embodiments. On the contrary, the invention is intended to cover alternatives, modifications and equivalents that may be included within the spirit and scope of the invention. Furthermore, in the following detailed description, numerous specific details are set forth in order to provide a thorough understanding of the present invention. However, it will be readily apparent to one skilled in the art that the present invention may be practiced without these specific details. In other instances, well-known methods, procedures, components, and materials have not been described in detail so as not to unnecessarily obscure aspects of the present invention.

For the sake of convenience and simplicity, the terms "coupled to" and "connected to" mean direct or indirect coupling, connection or communication unless the context indicates otherwise. These terms are generally used interchangeably herein, but are generally given their art-recognized meanings. Also, for convenience and simplicity, the terms "RF," "RFID," "NFC," and "identification" may be used interchangeably with respect to intended uses and/or functions of a device and/or tag, and the term "EAS tag" or "EAS device" may be used herein to refer to any EAS and/or surveillance tag and/or device. Also, the terms "integrated circuit" and "integrated circuitry" refer to a unitary structure comprising a plurality of electrically active devices formed from a plurality of conductor, semiconductor and insulator thin films, but generally does not include discrete, mechanically attached components (such as die, wire bonds and leads, a carrier or other substrate, or an antenna and/or inductor component), or materials having primarily an adhesive function. The term "antenna" may refer to an antenna, an inductor, or an antenna and inductor, unless the context of its use clearly indicated otherwise.

The technical proposal(s) of embodiments of the present invention will be fully and clearly described in conjunction with the drawings in the following embodiments. It will be understood that the descriptions are not intended to limit the invention to these embodiments. Based on the described embodiments of the present invention, other embodiments can be obtained by one skilled in the art without creative contribution and are in the scope of legal protection given to the present invention.

Furthermore, all characteristics, measures or processes disclosed in this document, except characteristics and/or processes that are mutually exclusive, can be combined in any manner and in any combination possible. Any characteristic disclosed in the present specification, claims, Abstract and Figures can be replaced by other equivalent characteristics or characteristics with similar objectives, purposes and/or functions, unless specified otherwise.

Embodiments of the present invention relate to a wireless communication device having an integrated ferrite shield, and methods of making and using the same. The present device provides a patterned ferrite layer that advantageously mitigates the effects of metal objects proximate to magnetically coupled transponders. Furthermore, the present invention advantageously lowers manufacturing costs compared to systems using conventional ferrite-based shielding.

Exemplary Wireless Communication Devices(s)

In one aspect, the present invention relates to a wireless communication device, comprising a receiver configured to convert a first wireless signal to an electric signal, a transmitter configured to generate a second wireless signal, a substrate with an antenna thereon, a patterned ferrite layer overlapping the antenna, and an integrated circuit in electrical communication with the antenna. The antenna receives the first wireless signal and transmits or broadcasts the second wireless signal. The patterned ferrite layer (e.g., a ferrite shield) advantageously mitigates the deleterious effect of metal (e.g., one or more metal objects) in proximity to a reader and/or transponder magnetically coupled to the antenna.

FIG. 1 is a cross-section of an exemplary wireless communication device 100 according to the present invention. FIG. 1 shows a substrate 110 with an antenna 120 thereon. Generally, the antenna 120 is on a first surface of the substrate 110. An integrated circuit 140 on a second substrate 150 may be on the same side of the substrate 110 as the antenna 120, as shown. The integrated circuit 140 is adhered to the antenna 120 by nonconductive adhesive 160 and electrically connected to the antenna 120 by conductive bumps 145, which may, in various embodiments, comprise a noble metal (e.g., silver, gold) or other conductive metal or alloy (e.g., aluminum, solder, etc.) that may be relatively malleable and/or reflowable. In addition, the conductive bumps 145 may include various other conductive solids, such as carbon nanotubes or silver, and/or an anisotropic conductive adhesive. Alternatively, the integrated circuit 140 may be formed on the first surface of the substrate 110, and the antenna 120 may be formed thereover (e.g., by printing, roll-to-roll placement and adhesion, etc.).

In the embodiment shown in FIG. 1, a patterned ferrite layer 130 is on a second surface of the substrate 110. The patterned ferrite layer (e.g., EMI or ferrite shield) 130 advantageously mitigates the deleterious effect of a metal object 170 (such as a metal shelf, metal housing or casing of another device, etc.) in proximity to a reader and/or transponder magnetically coupled to the antenna 120. Alternatively, the ferrite layer 130 may be formed on a disposable substrate, such as paper or a silicone release paper (e.g., paper coated or treated with a silicone release or non-stick agent), and an adhesive layer formed on the ferrite layer 130. Using a disposable substrate such as paper also eliminates potential problems with shrinkage of PET substrates (which may be up to 3%) during heating to dry and/or cure the ferrite ink or paste. After the ferrite layer 130 is attached to the antenna 120 or first substrate 110, the disposable substrate is subsequently removed.

In various embodiments of the present invention, the substrate 110 may comprise a glass, a glass/polymer laminate, a high temperature polymer such as a polyimide or polyethylene terephthalate (PET), or a metal foil such as stainless steel, aluminum, copper, or titanium foil. In certain embodiments, the substrate 110 is flexible (e.g., comprises a polymer or metal foil). Stainless steel substrates can be annealed at higher temperatures than plastic substrates, and can provide a different performance. Additionally, the substrate 110 may further include one or more insulative and/or barrier layers or coatings. For example, silicon dioxide and/or silicon nitride, aluminum oxide, or a conductive barrier material such as titanium nitride can be used as the insulative and/or barrier layer or coating.

The antenna 120 is configured to receive and transmit or broadcast wireless signals. The antenna 120 may comprise one or more layers of metal in a spiral pattern comprising a plurality of coils or loops. In various embodiments, the metal may comprise or consist essentially of aluminum, silver, gold, copper, palladium, titanium, chromium, molybdenum, tungsten, cobalt, nickel, platinum, zinc, iron, or a conductive alloy thereof. The antenna 120 may be printed on the substrate 110, and therefore may have physical and electrical qualities of a printed structure (e.g., greater dimensional variability, greater surface roughness, and a more curved and/or sloped cross-sectional profile than a blanket-deposited and photolithographically-patterned metal). Generally, larger antennas have a greater read range.

In some embodiments, the ferrite layer 130 is printed or formed in a pattern on the second surface of the substrate 110. The patterned ferrite layer 130 is configured to mitigate or counteract the electromagnetic effects of the metal object 170 on or near a surface of the wireless device. Generally, the patterned ferrite layer 130 is relatively thin, and has a thickness of 50 μm to 600 μm (e.g., 60-300 μm, 100-200 μm, or any value or range of values therein). The thickness of the patterned ferrite layer 130 may depend on the performance of the ferrite and the percentage loading of the ferrite in the overall ferrite shield composition. Similarly, the performance of the ferrite shield may depend on the proportion of the ferrite or ferrite precursor powder in the ferrite shield composition. For example, the more ferrite material in the composition, the better the shielding capabilities. The patterned ferrite layer 130 may be flexible and may also be manufacturable in roll form. As a result, roll-to-roll processing may be desirable during downstream processing of the patterned ferrite layer 130 after its manufacture. As will be discussed in more detail with regard to FIGS. 4A-C, the patterned ferrite layer 130 has a shape or pattern that substantially overlaps or covers the antenna 120, preferably with minimal coverage of areas not overlapping with the antenna 120. Performance may increase if the ferrite shield covers (e.g., overlaps and/or is larger than) the antenna 120 that it is shielding.

Generally, the patterned ferrite layer 130 comprises a soft ferrite, such as silicon steel or a compound of the formula $M_aZn_{(1-a)}Fe_2O_4$, where M is Mn or Ni, and a is between 0 and 1. Silicon steel generally comprises particles or a powder of a steel alloy having from about 1% to about 15% (by moles or by weight) of silicon therein, such as that found in silicon steel products commercially available from Tokyo Denkikagaku Kogyo (TDK) of Minato, Japan or NEC Tokin of Sendai-shi, Japan. Such silicon steel particles or powder may be grain-oriented or non-oriented. In other examples, the patterned ferrite film may further include aluminum (Al, for example in an amount of from 1-10% by weight or by moles) or chromium (Cr, for example in an amount of from 0.5-5% by weight or by moles). Alternatively, the patterned ferrite layer 130 may comprise a hard ferrite, such as iron oxide or a compound of the formula $M^IFe_{2b}O_{(3b+1)}$, where M is Sr, Ba or Co, and b is from 1 to 6 (e.g., $SrFe_{12}O_{19}$, $BaFe_{12}O_{19}$, or $CoFe_2O_4$). Alternatively or additionally, the patterned ferrite film may include a combination of ferrite particles and a metal. Each ferrite particle may further include an insulative coating. For example, the surface of the ferrite particles can be treated with an insulator such as a titanate (e.g., $M^{n+}_xTiO_y$, where y is 3 or 4, and n*x=2y−4) or zirconate (e.g., $M^{n+}_xZrO_y$, where y is 3 or 4, and n*x=2y−4). Such an insulative coating may improve manufacturability (e.g., lower viscosity) of the patterned ferrite layer 130.

In various embodiments of the present invention, the patterned ferrite film 130 may be formed by printing an ink or a paste containing a ferrite or a ferrite precursor. The ferrite film 130 may be printed using screen printing, stencil printing, inkjet printing, gravure printing, flexographic printing, or other conventional printing technique known to those skilled in the art. Alternatively, the ferrite film 130 may be deposited in a pattern in a single step onto the substrate 110 (or dielectric layer on the antenna 120 when the antenna and patterned ferrite film 130 are on the same side of the substrate 110) using extrusion coating, painting, etc., where a relatively simple pattern (e.g., one or more lines or "stripes") for the ferrite shield can be used. In some embodiments, a cut-out or hole may be in a center of the ferrite film 130, without loss of performance. Further, in applications where a blanket film is desired, the ferrite film 130 may be coated onto the substrate 110 or dielectric layer (e.g., by extrusion coating, dip-coating, spin-coating, etc.). The patterned film may have a thickness within a range from 50 μm up to 600 μm, and a permeability of about 5-25 $H \cdot m^{-1}$ or $N \cdot A^{-2}$ depending on the raw ferrite material, the curing conditions, and the polymer binder (and, when present, the solvent in the ink).

By forming a patterned ferrite layer 130 (e.g., by printing and curing a ferrite-containing ink) directly onto the substrate 110 (e.g., the back of the antenna substrate), a patterned shield that covers only the location(s) of the antenna 120 without sacrificing read range performance may be fabricated. Alternatively, the patterned ferrite layer 130 may cover or overlap less than all (e.g., 50-99%) of the area of the antenna to reduce the cost of the EMI shield even further in applications where maximizing read range is less critical. In addition, the present device eliminates a need for an adhesive layer. As a result, the cost of an adhesive layer to secure the ferrite shield to the antenna or integrated circuit can be eliminated, and the cost of the ferrite shield may be reduced.

The ferrite film may be printed before or after the integrated circuit (e.g., chip) is attached to the antenna 120. Alternatively, the patterned ferrite layer 130 may be formed on substrate 110, before or after the antenna 120 is formed on the substrate, and the integrated patterned ferrite layer 130 and antenna 120 on the substrate 110 may be used in a low-profile inlay, or placed in a holder adapted for pick-and-place attachment of the integrated circuit 140 to the antenna 120 integrated with the patterned ferrite layer 130 on substrate 110. In further embodiments, the ferrite film and the antenna 120 (or the substrates coated with the ferrite film or on which the antenna 120 is formed) may be cut into predetermined shapes at various stages during the assembly process. In such further embodiments, the excess ferrite may be recovered and reused in additional shields.

In various embodiments of the present invention, the integrated circuit 140 may be attached to the antenna 120 in a face-to-face configuration (e.g., using a conductive or nonconductive adhesive 160). The integrated circuit 140 may contain CMOS integrated circuitry, and may be fabricated using printing and/or thin film processing technologies (e.g., conventional thin-film deposition and patterning equipment) on the substrate 150. The integrated circuit generally provides the functionality for one or more wireless applications, such as HF, VHF, NFC, electronic article surveillance (EAS) or radio frequency identification (RFID) tags, in any of a range of common frequencies (e.g., 8 MHz, 13 MHz, 900 MHz, 2.7 GHz, etc.). Thus, the integrated circuit 140 may include functional blocks such as a rectifier (e.g., configured to provide a DC voltage to other blocks in the integrated circuit 140 from the received wireless signal), a demodulator (e.g., configured to extract data and/or signal [s] from the received wireless signal), a modulator (e.g., configured to provide the signal to be transmitted or broadcast), an encoder (e.g., configured to provide data and/or other signal[s] to the modulator), a clock or timing signal generator, and an optional battery. The integrated circuit 140 may also include functionality for display applications such as display drivers and/or TFT backplanes, integrated memory such as printed EEPROM, one-time programmable (OTP) memory and/or read-only memory (ROM), bit lines and sense amplifiers for reading and/or outputting information from the memory, latches for temporarily storing information from the memory, sensor applications such as biosensors, hazard sensors, motion sensors, chemical sensors and/or temperature sensors, comparators, analog-to-digital converters, and combinations thereof.

Generally, the integrated circuit 140 comprises (thin film) transistors, diodes, optional capacitors and/or resistors, and metallization interconnecting such circuit elements (see, e.g., U.S. Pat. Nos. 7,687,327, 7,767,520, 7,701,011 and 8,796,125, and U.S. patent application Ser. No. 11/243,460, filed on Oct. 3, 2005, the relevant portions of which are incorporated herein by reference). The integrated circuit may be formed by thin film deposition and patterning techniques and/or printing. Typically, the receiver (which may comprise one or more blocks of circuitry in the integrated circuit 140, functionally coupled or connected to the antenna 120) is configured to convert a wireless signal received from a reader to an electrical signal. The transmitter is configured to generate a wireless signal to be broadcast by the tag 100. The ends of the antenna 120 may be connected to the integrated circuit via conductive bumps 145, and optionally, pads (e.g., in an uppermost metal layer of the integrated circuit 140) and/or wires (not shown).

Figure 2:
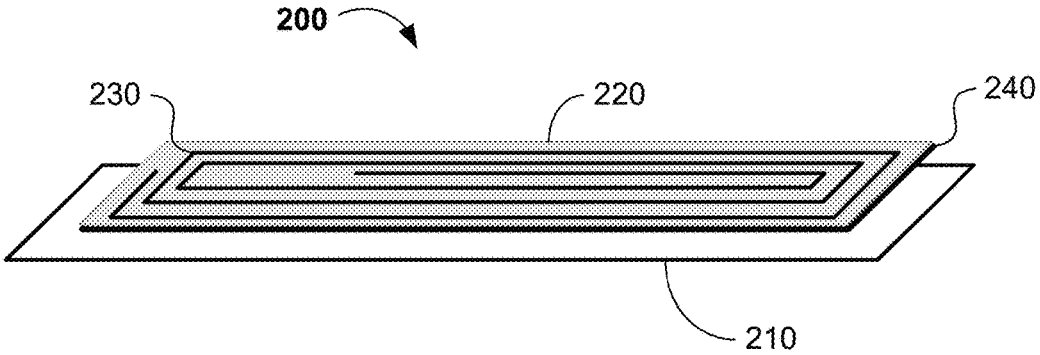
FIG. 2 is a perspective view of another exemplary integrated antenna and ferrite shield according to the present invention.

FIG. 2 is a perspective view of another exemplary integrated antenna and ferrite shield 200 according to the present invention. The device 200 generally comprises a flexible substrate 220 with an antenna 230 on a first surface thereof and a ferrite layer 240 (e.g., a ferrite shield) on a second surface thereof, between a device casing or housing 210 (e.g., an outermost protective layer of the device on which the integrated antenna and ferrite shield 200 is placed, such as a battery shell) and the substrate 220. The integrated antenna and ferrite shield 200 may be attached to the outer surface of the device casing or housing 210, the inner surface of the device casing or housing 210, or even integrated into the device inside the casing or housing 210. Integrating the magnetic shield (e.g., ferrite film 240) and wireless communication device advantageously prevents external electromagnetic interference (EMI) and shields the antenna from magnetic fields that may be within the device and/or inside the housing or casing 210.

The substrate 220 comprises a flexible material as discussed above. The antenna 230 is formed on a first side of the substrate 220. The antenna 230 may be formed, e.g., by (1) blanket-deposition, patterning and etching, or (2) printing, as described herein. If the antenna 230 is formed on a different substrate than the integrated circuit (not shown), the antenna may be connected to terminals of the integrated circuit by an adhesive (e.g., an anisotropic conductive adhesive), crimping, etc., e.g., in a pick-and-place process or by roll-to-roll processing. In various embodiments, the integrated circuit is attached to the antenna 230 in the same way as discussed with regard to the embodiment of FIG. 1.

The ferrite layer 240 is formed (e.g., by coating or printing) on the second surface of the substrate 220 in an area corresponding to and/or overlapping the area of the antenna 230, as discussed herein. Although the ferrite layer 240 is shown as a coating on the substrate 220 in FIG. 2, the ferrite layer 240 may also be formed in a pattern substantially covering the pattern of the antenna 220. For example, the ferrite layer 240 can be printed in a coil or ring pattern matching that of the antenna 230, or it can be extruded in strips along the length (i.e., the long axis) of the antenna 220, overlapping the long wires of the antenna 220.

Figure 3A:
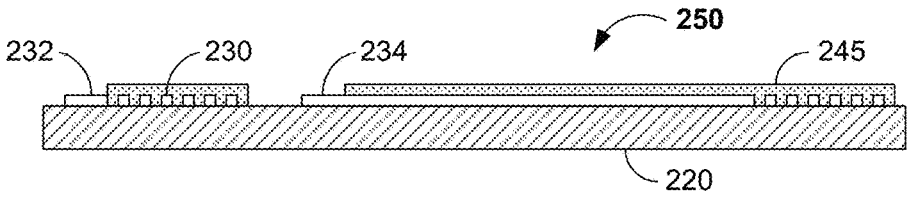
FIGS. 3A-3C show embodiments in which the ferrite layer and the antenna are formed on the same side of the substrate.

FIG. 3A shows a further alternative embodiment 250 in which the ferrite layer 245 is formed on the same side of the substrate 220 as the antenna 230, over the antenna 230. The ferrite layer 245 is printed in a pattern exposing antenna pads 232 and 234, for electrical connection to an overlying integrated circuit (not shown in FIG. 3A). In a further alternative, the ferrite layer 245 may be printed on the substrate prior to formation of the antenna 230. In such an alternative, the ferrite layer 245 is printed in a pattern under the entire antenna 230, including the pads 232 and 234, as a direct connection between the antenna pads 232 and 234 and an overlying integrated circuit can be made.

Figure 3B:
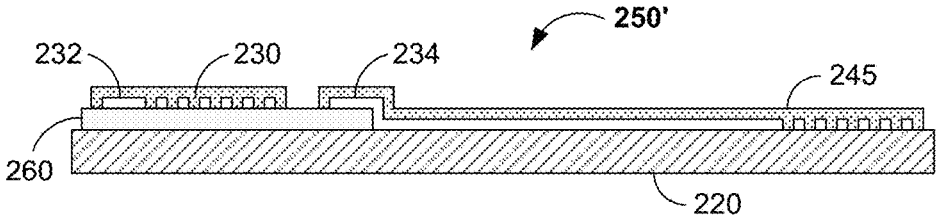

FIG. 3B shows a variation of a wireless tag 250' in which the integrated circuit 260 is first formed on the substrate 220, then the antenna 230 is formed (e.g., by printing or a combination of printing a seed layer and electroplating or electrolessly plating a bulk conductor on the seed layer) in part on the integrated circuit 260 and in part on the substrate 220. The antenna pads 232 and 234 are in electrical contact with a conductor in the integrated circuit 260 through openings in the uppermost passivation or dielectric layer(s) of the integrated circuit 260 (not shown).

Figure 3C:
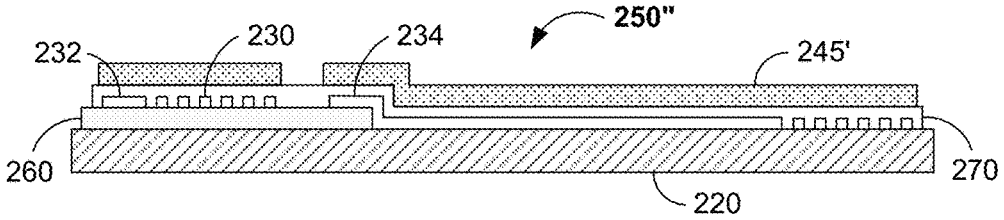

FIG. 3C shows an alternative wireless tag 250" in which a dielectric layer 270 is between the ferrite layer 245' and the antenna 230. The dielectric layer 270 may comprise a conventional insulator (e.g., silicon dioxide, which may be doped or undoped; an organic polymer, such as polyethylene, polypropylene, a polyester, a poly[meth]acrylate, a polycarbonate, a blend or copolymer thereof; silicon nitride; silicon oxynitride; aluminum oxide; an aluminosilicate; etc.) and may be formed by blanket deposition (e.g., spin-coating, chemical vapor deposition, etc.), extrusion, dip coating, or printing. Although the uppermost surface of the dielectric layer 270 generally is not completely planar, it is generally more planar than the topography of the antenna, and therefore provides a more uniform and/or even surface on which to form the ferrite layer 245'. In general, however, forming the ferrite layer on the surface of the substrate opposite from that on which the antenna is formed is preferred, as the ferrite layer is more uniform and provides an improved shielding function when it is on the opposite surface from the antenna.

Figure 4A:
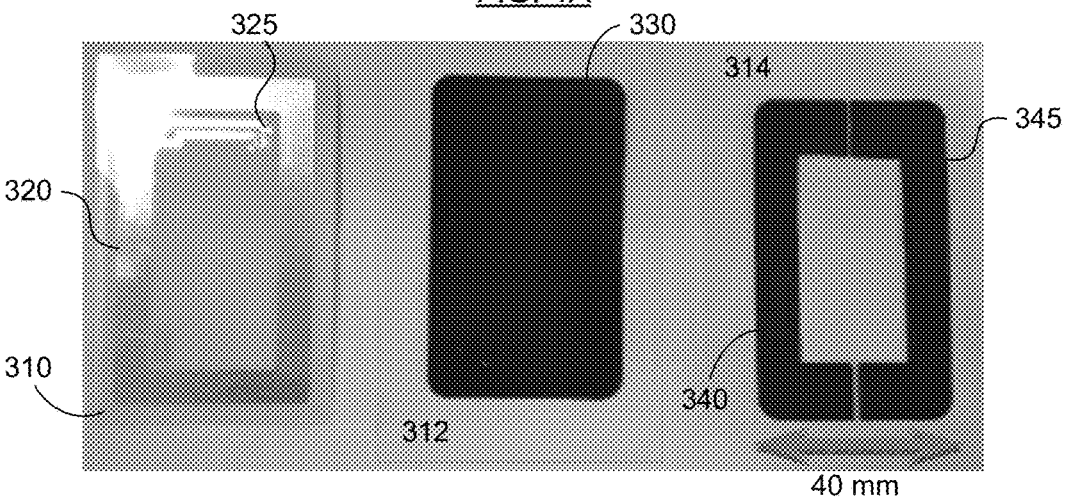
FIGS. 4A-4C show various printed ferrite layers according to the present invention.
Figure 4B:
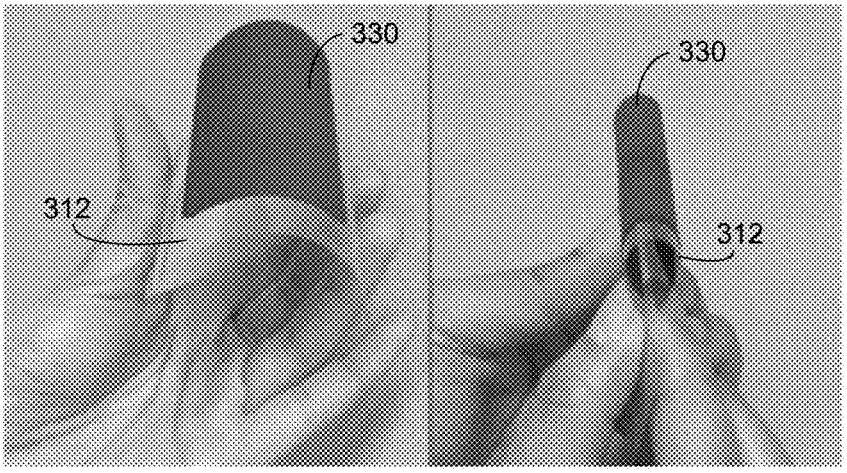
Figure 4C:
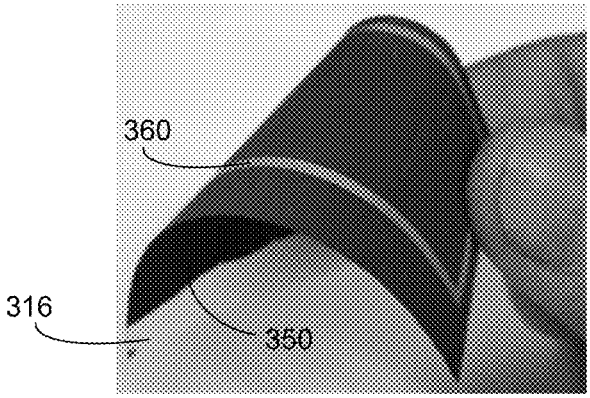

FIGS. 4A-4C show various examples of printed ferrite layers or films according to the present invention that effectively shield an NFC, EAS or RFID tag from electromagnetic effects of a nearby metal surface or object.

FIG. 4A shows an antenna 320 and terminals 325 (for bonding to an integrated circuit) on a PET substrate 310 (left picture), a printed blanket ferrite film 330 (middle picture) on a PET substrate 312 in a pattern that overlaps the antenna 320, and a bisected ring 340-345 (far right picture) in a pattern that overlaps the antenna 320 and shields the antenna 320 to the same degree as the blanket ferrite film 330. Both shields 330 and 340-345 were stencil-printed onto the substrates 312 and 314 and cured at 120° C., which is a processing temperature compatible with most plastics, including PET. In addition, when shielded by either ferrite shield 330 or 340-345, the antenna 320 had a read range of up to 10 mm using a Google Nexus phone and a monolithic silicon NFC communication/transceiver chip with an antenna having dimensions (e.g., an area) similar to those of a credit card. The ring-shaped ferrite shield 340-345 was printed in a pattern that covered only the antenna traces, but did not cover the antenna traces in the gaps along the short sides (e.g., at the top and bottom) of the antenna 320. Smaller and more intricate geometries may also be printed, depending on the antenna design and the application. Generally, the size and the area of the ferrite film are factors that influence the performance and/or shielding of the device.

Printed ferrite films show good adhesion to plastics typically used for antenna substrates, such as PET and polyimide substrates. In addition, ferrite films printed on plastic or metal foil substrates are relatively flexible. FIG. 4B shows the "blanket" patterned ferrite film 330 on flexible substrate 312 from the center picture in FIG. 4A. The peripheral dimensions (i.e., length and width along the outermost edges) of the patterned ferrite film 330 are about the same as those of the antenna 320. As is shown in the right picture of FIG. 4B, the printed ferrite layer 330 and substrate 312 are highly flexible and bendable. This enables roll-to-roll processing, in which a roll of dry inlays or pre-inlays (i.e., substrates with or without an antenna) may be printed with a ferrite ink in the pattern of the shield (which may correspond to the pattern of the antenna, with minor variations) on the surface of the substrate opposite from the antenna (e.g., the backside), before or after the antenna is formed on the substrate.

FIG. 4C shows a printed ferrite film 350 on the underside or back of a PET substrate 316 having an antenna 360 on the top or front surface of the substrate 316. The printed ferrite film 350 was cured at 120° C. for 10 minutes, conditions that are compatible with the material of the substrate 350. The antenna 360 comprises a printed copper coil, electroplated with silver to prevent oxidation of the antenna traces during the curing of the ferrite film 350. When the antenna 360 is made of or comprises aluminum, no additional plating steps are required to protect the antenna traces, since aluminum generally forms or includes a self-limiting oxide. Both the patterned or printed ferrite film 350 and the antenna 360 show excellent flexibility, and can be applied to small items with curved surfaces having relatively small radii.

A Ferrite Ink Composition and Method of Making the Same

The present invention further relates to a ferrite- or ferrite precursor-containing ink and/or paste that enables formation of ferromagnetic shielding films directly on a substrate in a wireless tag (or other wireless device). Such shielding films reduce the coupling of radio waves to and the effect of electromagnetic fields from surface(s) of nearby conductors, such that internal fields (e.g., in the tag) are attenuated, and external interference is canceled at low frequency. Ultimately, the present ink or paste allows formation of a shielding film that enables wireless communication devices (e.g., RF, EAS or NFC tags) to record and report conditions of operating or communicating instruments, which may have one or more metal components (such as a casing or housing) in close vicinity of the tag (e.g., to which the tag is attached). The integration of an electromagnetic shield with the antenna advantageously reduces material costs and additional packaging steps, and enhances the user interactive functionality of wireless communication devices.

Another aspect of the present invention therefore relates to a composition that generally comprises a ferrite or ferrite precursor, a polymer binder, and optionally, one or more solvents in which the polymer binder is soluble and in which the ferrite or ferrite precursor is soluble or suspendable. The present composition enables formation of a flexible, thin ferrite film that binds directly to a substrate and that magnetically shields the wireless tag and antenna.

The composition may comprise, but is not limited to, soft ferrites and/or precursors thereof, such as MnZn ferrite powders, NiZn ferrite powders, silicon steel (e.g., an iron-based alloy, such as iron alloyed with from 1.0-15 wt. % or at. % of Si, up to 10 wt. % or at. % of Al, up to 5 wt. % or at. % of Cr, and up to 0.5 wt. % or at. % of Mn), mixtures of Zn powder with (i) Mn or Ni powder and (ii) iron or iron (II) oxide powder in a proportion that forms a soft ferrite upon heating or annealing, etc. The composition may have a specific density of from about 2 g/ml to about 7 g/ml, and in one example, about 3 g/ml. Alternatively, the composition may comprise a hard ferrite or hard ferrite precursor, such as $Fe_2O_3$ or a metal oxide of the formula $MFe_{2x}O_{3x+1}$ (where M is an alkali or late transition metal in the +2 oxidation state such as Sr, Ba or Co, and x is from 1 to 6), and combinations thereof. Thus, the composition may contain one or more metal and/or metal oxide powders and/or flakes. The powders or flakes may range in size from a few nanometers to 100 μm (e.g., 1-100 μm, 10-50 μm or any value or range of values therein). Typically, larger flakes and/or particles form better shields. Using a mixture of ferrite particles having various particles sizes may produce a higher loading of ferrite, resulting in a more effective and/or thinner product. The range of particle sizes that may be used may approach the thickness of the desired shield or patterned ferrite layer. For example, a ferrite shield having a 200 μm thick may be formed from a composition including ferrite particles having a size of less than 200 μm (e.g., 50-100 microns, or any value or range of values of less than 200 μm).

In addition, when the ferrite particles adhere to themselves after being shaped into a thin sheet, such a sheet may produce the highest shielding performance. The process for forming such a sheet may include sintering (e.g., at a temperature and for a length of time sufficient to cause the ferrite particles to adhere to each other). However, such sintering may need relatively high temperatures (e.g., in excess of 250° C., 300° C. or more), and may produce metallurgical changes in the ferrite properties. In addition, difficulties in maintaining the shape of the ferrite layer may occur during the sintering process. Thus, if the ferrite particles do not adhere to themselves under the conditions in which the ferrite shield is processed, a binder may be necessary to hold the ferrite particles together. Such binders generally include a polymer. Generally, since the ferrite particles are not flexible, the flexibility of the product may be achieved via the binder. Very flexible polymers (e.g., polymers having a modulus of elasticity of <3 GPa or any value or range of values thereunder, such as 0.01-2 GPa) are desirable in the binder system.

Polymer binders may include (but are not limited to) polyethylenes, polyethylene copolymers, polyesters, polyacrylates, polymethacrylates, polyurethanes, polyimides, polytetrafluoroethylene, polydimethylsiloxane, certain epoxide polymers such as poly(alkylene oxides), polyepichlorohydrin and epoxycyclohexylethyltrimethoxysilane, alkylene-vinyl acetate copolymers such as ethylene-vinyl acetate copolymers (e.g., ELVAX EVA copolymer resin, available from DuPont, Wilmington, Del.), alkylene-styrene copolymers and blends such as styrene-ethylene/butylene-styrene (SEBS), alkylene-(meth)acrylic acid and -(meth)acrylate copolymers and blends such as ethylene-acrylic acid (e.g., NUCREL copolymer resin, available from DuPont, Wilmington, Del.), butadiene- and/or isoprene-based polymers such as butadiene-styrene block copolymers (e.g., KRATON G, available from Krayton Polymers, Houston, Tex.), poly(bisphenols), resins thereof, copolymers thereof, blends thereof, etc. In exemplary embodiments, flexible polymers, such as ethylene vinyl acetate (EVA), rubbers, thermoplastic polyurethanes, poly(ethylene-acrylic acid), but not limited thereto, that are thermally stable for at least a short period of time (e.g., 1 hour or more) at approximately 200° C. may have the ability to form flexible compositions at high ferrite loadings.

One or more such polymers may be mixed in the composition. Typically, use of a binder that shrinks (e.g., as it is heated to extrude a hot-melt composition or to remove solvent in a solvent-containing composition) may be advantageous, as it minimizes the space between ferrite particles or flakes in the composition, thereby increasing adhesion, conductivity, and flexibility of the formed ferrite layer. The composition may also include additives such as surfactants (e.g., to aid dispersion) and/or stabilizers (e.g., to reduce oxidation of the ferrites and/or thermal breakdown of the polymers at elevated temperatures or reduce long-term environmental exposure to air).

Various resins of the polymer binders may include a poly(aryl alkene) such as polystyrene; a polyester or polyester-polystyrene copolymer; high cohesive resins, such as epoxy resins; aryl alkene-alkene/alkadiene, cyanoalkene-alkene/alkadiene, alkanoic acid/ester-alkene/alkadiene, and alkenol/alkenol ester-alkene/alkadiene rubbers such as styrene-butadiene rubber (SBR), styrene-isoprene-styrene rubber (SIS), styrene-isoprene-butadiene-styrene rubber (SIBS), styrene-butadiene-styrene rubber (SBS), acrylonitrile-butadiene rubber (NBR), methyl methacrylate-butadiene rubber (MBR), styrene-ethylene-propylene-styrene rubber (SEPS), styrene-ethyl ene-butadiene-styrene rubber (SEBS), styrene-ethylene-ethylene-propylene-styrene rubber (SEEPS) and ethylene-vinyl acetate resin; polyamide resins; a solvent-type resin system (e.g., acrylic resin); combinations thereof, etc. Other resins may include vinyl acetate or vinyl acetate and an acrylate ester copolymerized in a vinyl acetate resin system; vinyl chloride monomer (VCM)/polyvinyl chloride (PVC) resins; vinyl acetate, ethylene, and an acrylate ester copolymerized in a VCM/PVC resin system; styrene and an acrylate ester copolymerized in a styrene resin; ethylene and vinyl acetate copolymer resins; urethane resins; acrylate-urethane resins; polyester-polyurethane resins; denatured silicone resins; moisture powder-type resin systems (e.g., synthetic rubber systems including latex or styrene-butadiene rubber latex); acrylonitrile-butadiene rubbers, methyl methacrylate-butadiene rubbers, and/or chloroprene rubbers subjected to a carboxyl denaturation process; acrylic acid ester resin emulsions prepared using acrylate monomers, such as various acrylate esters; vinyl acetate resin emulsions copolymerized with vinyl acetate or a combination of vinyl acetate and one or more comonomers (e.g., an acrylate ester and VEOVA™ vinyl neodecanoate monomer, available from Momentive Specialty Chemicals, Inc., Columbus, Ohio); vinyl chloride resin emulsions in which comonomers, such as VCM/PVC, vinyl acetate, ethylene and/or acrylate ester are (co)polymerized; styrene resin emulsions and ethylene and vinyl acetate copolymer emulsions that may be copolymerized with styrene and/or comonomers such as an acrylate ester; and moisture curing type resins, such as denatured silicone resins, cyanoacrylate resins, and urethane resins.

Typically, when determining the percentage of binder to ferrite, there is a trade-off between the percentage of binder used (e.g., a higher percentage of binder may produce better mechanical properties) and the percentage of ferrite (e.g., a higher percentage of ferrite may produce better shielding properties). Proportions of ferrite or ferrite precursor to polymer binder may range from 1:1 to 100:1 on a weight basis. The most effective combinations of permeability and thickness are achieved at a relatively high mass loading of ferrite, generally at least 90% by weight relative to the combined mass of the ferrite or ferrite precursor and polymer. In one example, mass loading of components for the shielding composition were fixed at 96% to 4% weight to weight of the ferrite and polymer.

Various solvents may be used to make a printable ink, such as $C_3$-$C_6$ ketones (acetone, methyl ethyl ketone [MEK]), $C_6$-$C_{10}$ arenes, such as benzene, toluene, xylenes, or other arene substitutes with one to three $C_1$-$C_4$ substituent groups (e.g., mesitylene, phenylethane, 2-phenyl-2 methyl propane, tetrahydronaphthalene, etc.), $C_4$-$C_{10}$ ethers (e.g., diethyl ether, methyl t-butyl ether, etc.), $C_1$-$C_6$ esters of $C_1$-$C_6$ alkanoic acids (e.g., ethyl acetate), $C_6$-$C_{12}$ alkanes and cycloalkanes, water, $C_1$-$C_4$ alcohols, combinations and mixtures thereof, etc., but are not necessarily limited thereto. Generally, the solvent depends on the type of polymer binder, and should be a solvent in which the polymer(s) is/are soluble. The solvent should also be one that can easily and completely be removed from the composition during drying and curing. For printing, the viscosity of the ink composition may be from 10 cPs to 500,000 cPs (e.g., 10 cPs to 500 cPs for inkjet printing, 100 cPs to 250,000 cPs for screen printing, or any other appropriate value or range of values therein for a particular printing technique).

In various embodiments, the ferrite powder can be dispensed into the polymer binder and one or more solvents to form a paste, semi-paste or liquid ink. In such embodiments, the solvent may be present in an amount of from 1 to 500 parts by weight per 100 parts by weight of the combination of ferrite/ferrite precursor and polymer. Alternatively, the solvent can be omitted entirely, and the polymer may be selected to form an injectable or extrudable composition (a kind of "hot-melt" composition) that forms a flowable or liquid-like suspension at a temperature greater than ambient temperature, but less than the maximum processing temperature of the substrate. For example, using a PET substrate, the polymer for the present composition should have a melting point of from about 40° C. to about 190° C., or a glass transition temperature of less than about 120° C., thereby enabling rheological properties for the composition sufficient to extrude the composition under the conditions for processing the ferrite film. Alternatively, using a stainless steel foil substrate, the polymer may have a melting point of from about 40° C. to about 400° C., or a glass transition temperature of less than about 300° C., to enable such rheological properties.

Experiment 1: Preparation of Polyester (Baseline) Binder Solution (20 wt %)

19 parts by weight of polyester SP185 to 1 part by weight of polyester TP220 (both of which are available from Nippon Synthetic Chemical Industry Co., Ltd., Osaka, Japan) were placed into a clean glass jar. 64 parts by weight of xylenes and 16 parts by weight of MEK were placed separately into the same jar with a magnetic stir bar, and the polyesters were dissolved in the solvents by mixing or stirring overnight. The solution is clear when the polyesters are completely dissolved. The viscosity of the polyester binder solution is 1000 cPs±50 cPs.

Experiment 2: Preparation of Polytetrafluoroethylene (PTFE) Binder Paste and Ferrite Paste Including the Same 1 part by weight of PTFE polymer was weighed into an aluminum weighing pan. In addition, 1.0 part by weight of a hardener was weighed in to the same weighing pan. The polymer and hardener were transferred to a jar, and 2.0 parts by weight of acetone was added. Additional acetone may be added, if necessary or desired, to extend the incubation or working time. The amount of acetone is not a factor in the final volume (ml) of paste. Using a small spatula, the paste was mixed thoroughly and additional acetone was used, if necessary or desired. To make the ferrite-containing paste, 4 parts by weight of ferrite powder was added to the mixture of PTFE and hardener in acetone and mixed further with the spatula until consistent.

Experiment 3: Preparation of Polydimethylsiloxane (PDMS) Solution 10 parts by weight of PDMS was added to a clean glass jar. 40 parts by weight of xylene was added separately into the same jar to dissolve the PDMS. A magnetic stir bar was placed in the solvent/polyester mixture and stirred overnight until the solution became a single phase. When the solution is uniform, the solution is translucent and has an even flow.

Experiment 4: Preparation of Ferrite Ink or Paste

An ink or paste containing 96 wt % ferrite powder (referred to as the final mass loading [FML]) was prepared as follows. 19.2 parts by weight of nickel zinc ferrite ("NiZnFeO") or iron (Fe) powder was weighed into a glass vial. 4 parts by weight of the 20 wt % solution of PDMS or polyester binder was weighed into the vial. Using a vortex mixer, the paste was mixed thoroughly for 5-10 minutes until the ferrite powder was uniformly dispensed into the binder solution. This produced a solution or suspension of powder having a 96 wt % FML of ferrite in the binder. If the solution turned brown, it was discarded.

An FML of ferrite powder in the ferrite-binder mixture of 90% or greater is acceptable and/or sufficient for printing ferrite films.

Experiment 5: Printing, Curing and Characterizing the Ferrite Film 1 ml of a thick PET film was loaded on an even, A4 letter-sized surface to form a substrate. To control the thickness of the applied ferrite film, the screen or stencil included an arguy pattern (e.g., a diamond cross in the middle of the screen or stencil). The screen or stencil was placed on the PET film (after drying), and about 5.0 g of ferrite ink was dispensed onto the screen or stencil using a spatula at the far end of the arguy. A flexible credit card was used to squeeze the ink through the screen or stencil, moving from the far end to the near end. Steady pressure was applied. The process generally was not reversed, and excess material was discarded (in a further embodiment, the ferrite material can be recovered by washing with an organic solvent [to remove the polymer binder] and drying). The ferrite ink in the open air is rheopectic, which leads to poor uniformity in printing. The average wet film thickness was 250-300 μm, and the average weight of the ferrite ink printed onto the PET film was about 4.7 g before curing.

The PET substrate with the ferrite film printed thereon was allowed to cool and solvents to slowly evaporate at room temperature. After the film surface became semi-glossy and dry, the PET film with the printed ferrite thereon was transferred to a cool hot plate. The temperature ramp was set from room temperature to 120° C. Once the temperature reached 120° C., the film incubated for 10 minutes at 120° C. The ferrite ink dried and strongly adhered to the PET film.

Two measurements were made to characterize the present ferrite film. In one example, a physical measurement of the thickness of the film in μm was made. The thickness of the combined film was measured in 5 spots, and the substrate thickness was subtracted from the average. In the other measurement, the dry weight of the film in grams (g) was used to characterize the ferrite film. Additionally, an electronic measurement of the device to determine read range in millimeters (see the description of Experiment 6 below) can be used to further characterize the ferrite film.

Experiment 6: Read Ranges of Tags Including the Present Ferrite Shield

Figure 5:
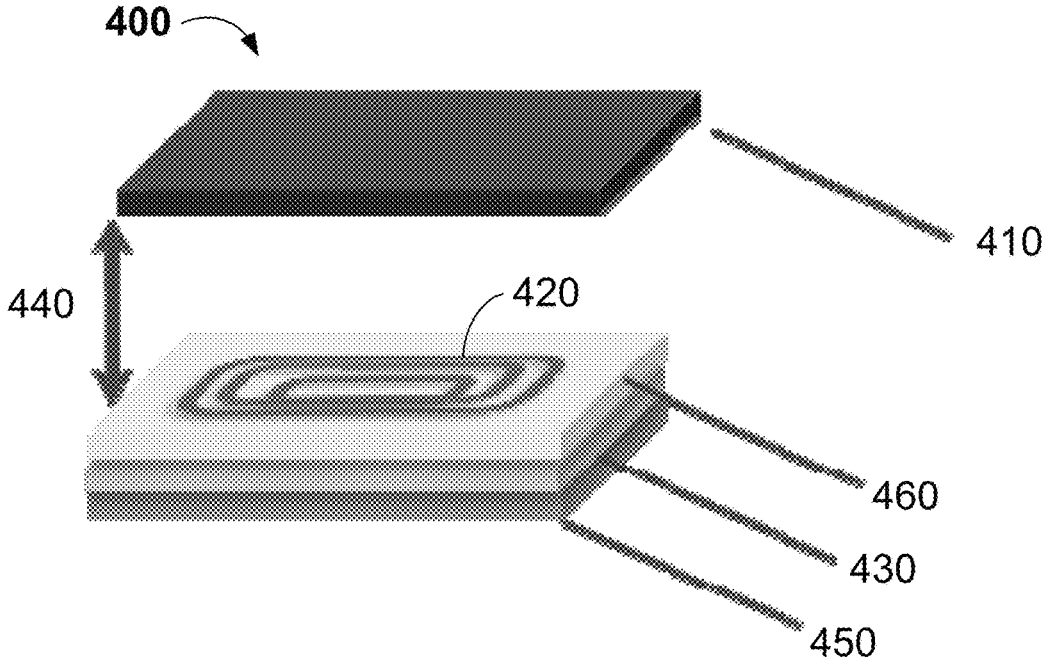
FIG. 5 shows an exemplary integrated antenna and ferrite shield in an NFC-enabled reading device.

FIG. 5 shows an exemplary wireless communication system 400 including an NFC phone 410 and an NFC tag 460, in which a patterned ferrite film 430 is integrated with an antenna 420 and an integrated circuit (e.g., the NFC communication/transceiver chip as described herein; not shown). The NFC tag 460 is proximate to a copper plate 450. The copper plate 450 is a model for a metal surface to which the present wireless communication device may be fixed or adhered, or on which an object with the present wireless communication device thereon may be placed. Generally, the read range of the NFC tag 460 is determined by measuring the maximum distance 440 that the NFC phone 410 may be held above the tag 460 and have repeatable reads (e.g., a minimum of 3 reads in a row). Typically, the read distances (e.g., a "yes/no" type response from the tag 460 read by the phone 410) are recorded in 2.5 mm increments using paper spacers (not shown).

FIG. 6 is a table summarizing shielding data for a variety of different printed ferrite shields, such as iron oxides and barium ferrites, showing that good read ranges can be obtained using ferrite shields with thicknesses greater than 100 μm in the presence of a metal (copper) sheet. Read ranges in FIG. 6 of the various ferrite shields are shown in mm (see, e.g., the column labeled "w/Cu sheet"). Blanket ferrite films having different thicknesses were printed in accordance with Experiment 4 above, from inks including various raw ferrite material powders from various vendors (prepared in accordance with Experiments 1-3 above) and evaluated for read range performance in accordance with the preceding paragraph. The raw ferrite material powder was either a MnZn powder or a NiZn powder having a particle size or diameter of about 10-15 μm. Various MnZn and NiZn powders from different manufacturers were tested. The composition of the silicon steel material was 85 wt % iron, 5.3 wt % aluminum, and 9.1 wt % silicon. The silicon steel material had a diameter of about 30-60 μm, an aspect ratio of about 1:30 to about 1:60, and a mass loading of about 40-70 vol %. When the tag could not be read, the read range is indicated by a zero (0). A contact read only (NFC phone and antenna are in direct contact with one another) is indicated by a read range of "0.1 mm". Based on read performance, ferrite powder properties, and comparisons to conventional shielding data, the magnetic permeability of the ferrite film was estimated (see, e.g., the column labeled "Estimated u"). Permeabilities of 5-25 $H \cdot m^{-1}$ or $N \cdot A^{-2}$ were regularly achieved.

Exemplary Integrated Circuits

Figure 7:
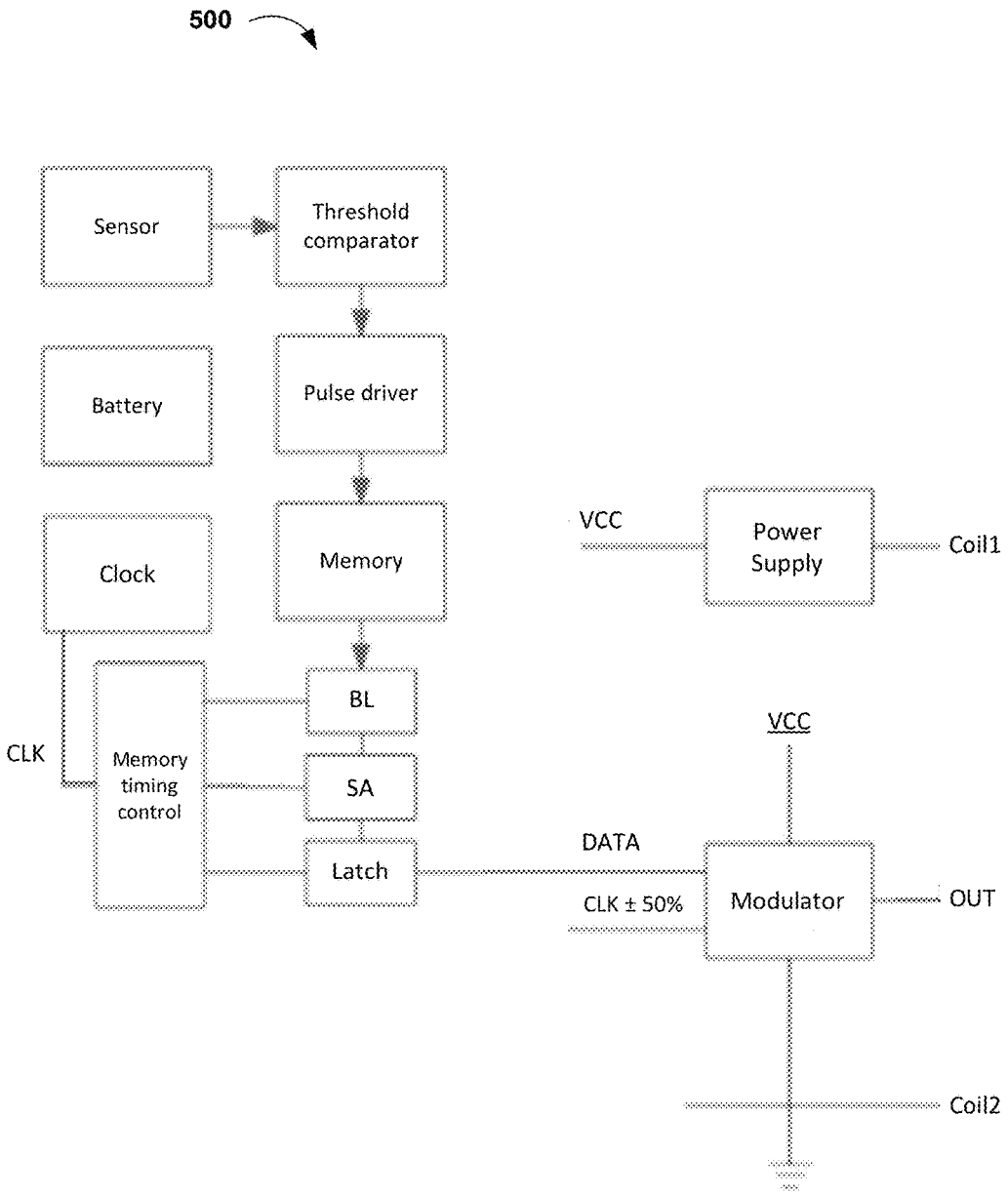
FIG. 7 shows an exemplary integrated circuit useful in embodiments of the present invention.

FIG. 7 shows an exemplary integrated circuit (IC) suitable for use in certain embodiments of the present wireless communication device. The IC may include one or more sensors, a threshold comparator receiving information (e.g., a signal) from the sensor, a pulse driver receiving an output of the threshold comparator, a memory storing sensor data from the pulse driver, one or more bit lines (BL) for reading data from the memory, one or more sense amplifiers (SA) for converting signal on the bit line(s) to digital signals, a latch for temporarily storing data from the sense amplifier(s), and a transmitter (e.g., modulator) configured to output data (including identification code) from the device. The exemplary IC in FIG. 7 also contains a clock configured to provide a timing signal (e.g., CLK) that controls the timing of certain operations in the IC and a memory timing control block or circuit that controls the timing of memory read operations. The modulator also receives the timing signal (CLK) from the clock circuit, or a slowed-down or sped-up variation thereof. The exemplary IC also includes a power supply block (e.g., a battery) or circuit that provides a direct current signal (e.g., VCC) to various circuits and/or circuit blocks in the IC. The memory may also contain identification code. The portion of the memory containing identification code may be printed. The IC may further contain a receiver (e.g., a demodulator), one or more rectifiers (e.g., a rectifying diode, one or more half-bridge or full-bridge rectifiers, etc.), one or more tuning or storage capacitors, etc. Terminals in the modulator and the power supply are connected to ends of the antenna (e.g., at Coil1 and Coil2).

Exemplary EAS Tags/Devices

Figure 8A:
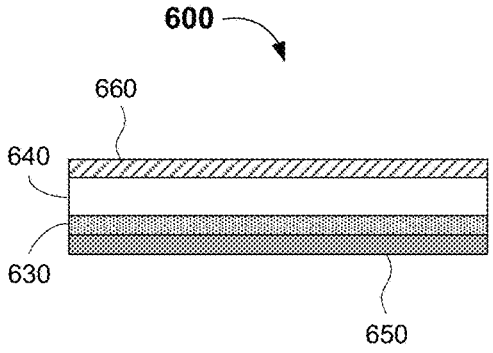
FIGS. 8A-8B show exemplary arrangements of a ferrite shield, resonant circuit, and spacer relative to a model metal surface.
Figure 8B:
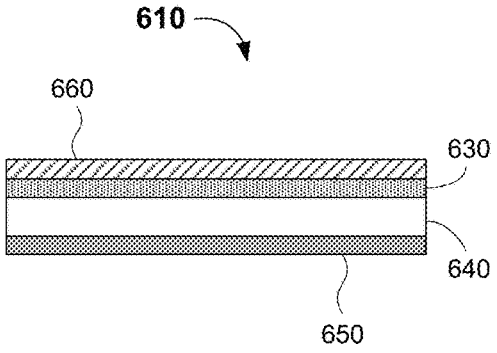

FIGS. 8A-8B show exemplary EAS devices comprising a ferrite shield, in which the ferrite shield is spaced apart from the tag (FIG. 8A), or the ferrite shield and tag are spaced apart from the metal surface (FIG. 8B). FIG. 8A shows an exemplary surveillance device 600 including an EAS tag (e.g., resonant circuit) 660, in which a patterned ferrite film (or shield) 630 is spaced apart from the EAS tag 660 by a spacer 640. The shield 630 is in contact with a metal surface (e.g., a copper sheet) 650 as a model for testing the effectiveness of the ferrite shield 630.

Figure 9A:
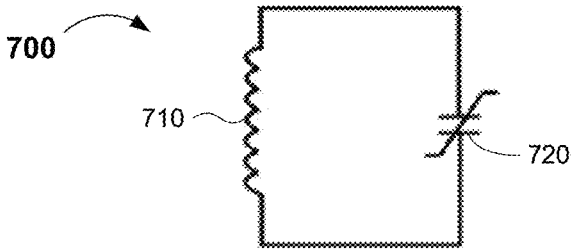
FIGS. 9A-9B show exemplary resonant circuits for use in EAS tags according to the present invention.

As shown in FIG. 9A, the EAS tag 660 includes a resonant circuit 700 comprising a capacitor 720 and an inductor 710. The capacitor may have a first electrode, and in some embodiments, the first electrode may comprise or be formed from a conductive substrate. Generally, the capacitor 720 further includes a second electrode and at least one dielectric layer between the first and second electrodes. The capacitor may further include a (semi)conductive layer on or in contact with at least a portion of the dielectric layer and/or the second electrode. Examples of EAS devices and resonant circuits therefor are disclosed in U.S. Pat. Nos. 7,152,804, 8,227,320, 8,264,359 and 8,933,806, the relevant portions of which are incorporated herein by reference.

In some embodiments, the spacer 640 is a substrate on which the patterned ferrite film 630 and the EAS tag 660 are formed. In various embodiments, the substrate 640 includes a dielectric or insulating material, such as paper, plastic, glass, ceramic, etc., any of which may be coated with an insulating material that improves the processing and/or the physical and/or electrical properties of the ferrite layer 630 and/or the EAS tag 660.

FIG. 8B shows an alternative exemplary surveillance and/or identification device 610 including the EAS tag 660 with the patterned ferrite film (or shield) 630 thereon, spaced apart from the metal surface (e.g., copper sheet) 650 by the spacer 640. The spacer 640 is on the metal sheet (e.g., the copper sheet) 650. The patterned ferrite film 630 overlaps the inductor in the EAS tag 660. The ferrite shield 630 may be integrated with the EAS tag 660.

Effectiveness of a Printed Ferrite Shield for EAS Tags

Tests were performed to demonstrate the effectiveness of the present printed ferrite film in an EAS tag. The devices 600 and 610 were used as models for an EAS tag on or in proximity to a metal surface, shielded by a ferrite film. When testing the EAS devices, the device was held approximately 18 inches laterally and 4 feet vertically from a standard/conventional EAS gate alarm. Various orientations of the tag were tested with regard to the alarm, such as having the tag parallel to the gate alarm, perpendicular to the gate alarm, or flat. If the alarm was not activated at 18 inches away from the gate alarm laterally, the tag was brought closer until the alarm was activated (i.e., sounded). Often, a delay of approximately 5-7 seconds occurred between the time that the tag was introduced and the alarm being activated.

In an initial control test, a 40 mm×40 mm EAS tag 660 was formed on a plastic substrate and placed on a copper plate 650 the size of a business card, with only the spacer 640 therebetween. Typically, spacers included one or more paper sheets, each having the size and thickness (2.5 mm) of a business card. The minimum spacer thickness (in mm) for all orientations to activate the alarm when the tag 660 was on the copper sheet 650 is about 12.5 mm, and for the tag on a metal container of baby formula is about 10-12.5 mm. The alarm gates were tuned to 8.2 MHz+/−10% (e.g., 7.38 MHz to about 9.02 MHz). Relatively high frequency shifts were observed with increasing proximity of the tag 660 to the copper sheet 650. The effects of the copper sheet 650 on the EAS tag 660 having only the spacer 640 therebetween are shown in Table 1 below.

TABLE 1

| Spacer Thickness (mm) | Q | Effective Volume (V) | Frequency (MHz) | Gate Alarm Behavior |
|---|---|---|---|---|
| 0 | NA | 0 | 0 | No alarm |
| 5 | NA | 0.12 | 9.376 | No alarm |
| 7.5 | 48 | 0.25 | 9.079 | No alarm (mis-tuning may account for no alarm in this test) |
| 10 | 55 | 0.39 | 8.76 | Parallel, flat orientations only |
| 12.5 | 59 | 0.48 | 8.6 | All orientations, delay |
| 15 | 61 | 0.59 | 8.441 | All orientations, delay |
| 20 | 66 | 0.77 | 8.335 | All orientations, delay |
| 30 | 67 | 1.07 | 8.248 | All orientations |
| None/Nominal Tag | 71 | 1.84 | 8.199 | Alarms @ all orientations |

In a comparison test, a conventional (pre-formed) ferrite shield and the spacer 640 were placed between the same EAS tag 660 and copper sheet 650 of the control test. The conventional ferrite shield used was a "K4E" silicon steel shield, commercially available from NEC Tokin, Sendai-shi, Japan. The permeability of the conventional ferrite shield is about 20, with a thickness of about 300 μm. The minimum spacer thickness for the copper sheet 650 is about 2.5 mm and for the baby formula container is about 5 mm, at 18 inches with the tag 660 parallel to the alarm gate, and less than 18 inches when the tag was flat or perpendicular to the alarm gate. The effects of the copper sheet 650 and the conventional ferrite shield on the EAS tag 660 is shown in Table 2 below.

TABLE 2

| | Conventional Shield/ Copper Combined | | | | Tag/Conventional Shield Combined | | | |
|---|---|---|---|---|---|---|---|---|
| Spacer Thickness (mm) | Q | Eff. Vol. (V) | Freq. (MHz) | Gate Alarm Behavior | Q | Eff. Vol. (V) | Freq. (MHz) | Gate Alarm Behavior |
| 0 | | | | | NA | 0.17 | 9.249 | No alarm |
| 2.5 | NA | 0.19 | 9.12 | All orientations, delayed | 20 | 0.19 | 8.66 | All orientations, delayed |
| 5.0 | 41 | 0.27 | 8.797 | All orientations, delayed | 33 | 0.24 | 8.179 | All orientations, delayed |
| 7.5 | 57 | 0.47 | 8.476 | All orientations, delayed | 38 | 0.31 | 7.964 | All orientations, delayed |

TABLE 2-continued

| Spacer Thickness (mm) | Conventional Shield/ Copper Combined Q | Eff. Vol. (V) | Freq. (MHz) | Gate Alarm Behavior | Tag/Conventional Shield Combined Q | Eff. Vol. (V) | Freq. (MHz) | Gate Alarm Behavior |
|---|---|---|---|---|---|---|---|---|
| 10.0 | 60 | 0.49 | 8.476 | All orientations, delayed | 46 | 0.39 | 7.834 | All orientations, delayed |
| None/ Nominal Tag | 71 | 1.84 | 8.199 | All orientations | 71 | 1.84 | 8.199 | All orientations |

Except at 0 mm spacer thickness, the spacer 640 was placed between the conventional shield and the copper sheet 650 in the tests labeled "Tag/Conventional Shield Combined" (i.e., the configuration in FIG. 8B), and between the conventional shield and the tag 660 in the tests labeled "Conventional Shield/Copper Combined" (i.e., the configuration in FIG. 8A). Approximately 10 Q points were gained when the spacer was between the tag 660 and the shield (i.e., the configuration in FIG. 8A). The conventional shield provides commercially acceptable results, even with as little as 2.5 mm spacing.

In the tests using the present printed ferrite shield 630, the EAS tag 660 was formed on a plastic substrate, as in previous tests. In one group, a printed and/or patterned ferrite film 630 was formed from a ferrite ink or paste prepared in accordance with Experiment 4 above on the side of the plastic substrate opposite from the tag 660 (see the "Tag/Printed Ferrite Combined" results in Table 3 below). In another group, the printed and/or patterned ferrite film was formed from the same ferrite ink or paste on a second plastic substrate (see the "Printed Ferrite/Copper Combined" results in Table 3 below). A spacer was placed between the same copper sheet 650 as in previous tests and the combined tag 660 and printed/patterned ferrite shield 630, or between the tag 660 and the printed/patterned ferrite shield 630. The minimum spacer thickness between the copper sheet 650 and the tag 660 is about 5 mm, and for the baby formula container is about 7.5 mm, in all orientations (parallel, perpendicular, or flat) at about 1 foot from the alarm gate. In all tests, the spacer thickness was adjusted until the alarm was activated (i.e., the alarm sounded). The effects of the copper sheet on the EAS tag with the patterned ferrite film as a function of the spacer thickness is shown in the following Table 3.

TABLE 3

| Spacer Thickness (mm) | Printed Ferrite/Copper Combined Q | Eff. Vol. (V) | Freq. (MHz) | Gate Alarm Behavior | Tag/Printed Ferrite Combined Q | Eff. Vol. (V) | Freq. (MHz) | Gate Alarm Behavior |
|---|---|---|---|---|---|---|---|---|
| 2.5 | 0 | 0.18 | 9.116 | No alarm | 0 | 0.16 | 8.795 | No alarm |
| 5.0 | 22 | 0.23 | 8.812 | All orientations, delayed | 11 | 0.17 | 8.235 | No alarm |
| 7.5 | 33 | 0.28 | 8.669 | All orientations, delayed | 13 | 0.21 | 8.003 | No alarm |
| 10.0 | 47 | 0.42 | 8.487 | All orientations, delayed | NA | 0.26 | 7.695 | All orientations, delayed |
| None/ Nominal Tag | 71 | 1.84 | 8.199 | All orientations | 71 | 1.84 | 8.199 | All orientations |

Approximately 10-20 Q points were gained when the spacer was between the printed/patterned ferrite film 630 and the EAS tag 660. These tests showed that ferrite films printed or patterned from an ink or paste provided commercially acceptable results even at 5 mm spacing.

Alternative EAS Tags

Figure 9B:
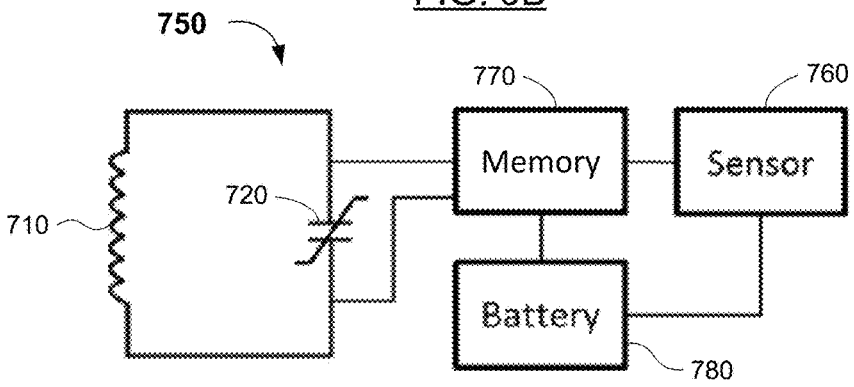

FIGS. 9A-B show exemplary resonant circuits 700 and 750 for an EAS tag suitable for use in the present invention. FIG. 9A shows the exemplary resonant circuit 700 of the surveillance and/or identification device of FIG. 8B. Generally, the EAS tag 700 includes an inductor (e.g., an inductor coil) 710 and a capacitor 720. The capacitor 720 may be linear (as shown) or non-linear, in which case it may further include a semiconductor layer, on or in contact with at least a portion of the dielectric layer and/or the second electrode, as described herein. In the presence of an oscillating wireless signal (or electromagnetic field), the inductor 710 is configured to generate or produce a current in the resonant circuit 700 sufficient for the tag to backscatter detectable electromagnetic (EM) radiation. For example, the LC circuit 700 may be tuned to a resonant frequency around 8 kHz, and an antenna in a walk-through alarm gate is configured to detect an impedance change at the resonant frequency. Under such conditions, detection of backscattered EM radiation by a reader (e.g., in the alarm gate) triggers an alarm. In some embodiments, the resonant circuit 700 may further comprise a second capacitor coupled with the first capacitor. The second capacitor may be sensitive to a change in resonant frequency (e.g., of the reader/detector and/or the circuit 700).

Alternatively, the capacitor 720 may comprise a ferroelectric capacitor. In such a case, the resonant circuit 700 induces a voltage into a coil in the reader/detector, which is configured to detect a $2^{nd}$ and/or $3^{rd}$ order harmonic of the resonant frequency).

FIG. 9B shows an exemplary resonant circuit 750 for an EAS tag with a sensor 760, suitable for use in the present invention. The resonant circuit 750 also includes the inductor 710, the capacitor 720, a memory 770, and a battery 780 that powers the memory 770 and the sensor 760. The sensor 760 may comprise an environmental sensor (e.g., a humidity or temperature sensor), a continuity sensor (e.g., that determines a sealed, open, or damaged state of the package or container to which the tag is attached), a chemical sensor, a product sensor (e.g., that senses or determines one or more properties of the product in the package or container to which the tag is attached), etc., and outputs an electrical signal to the memory 770 corresponding to the condition, state or parameter sensed or detected by the sensor 760. The memory 770 stores one or more bits of data, at least one of which corresponds to the condition, state or parameter sensed or detected by the sensor 760, and one or more of which may correspond to an identification number or code for the product to which the tag is attached. The memory 770 outputs a data signal that can be read by the reader. Thus, the reader is capable of detecting an initial state of the memory 770. Additional circuitry can be added to the circuit 750 to change the state of the memory 770. In addition, such additional circuitry can write data or a state to a ferroelectric capacitor (when present).

An Exemplary Method of Manufacturing a Wireless Communication Device

Figure 10:
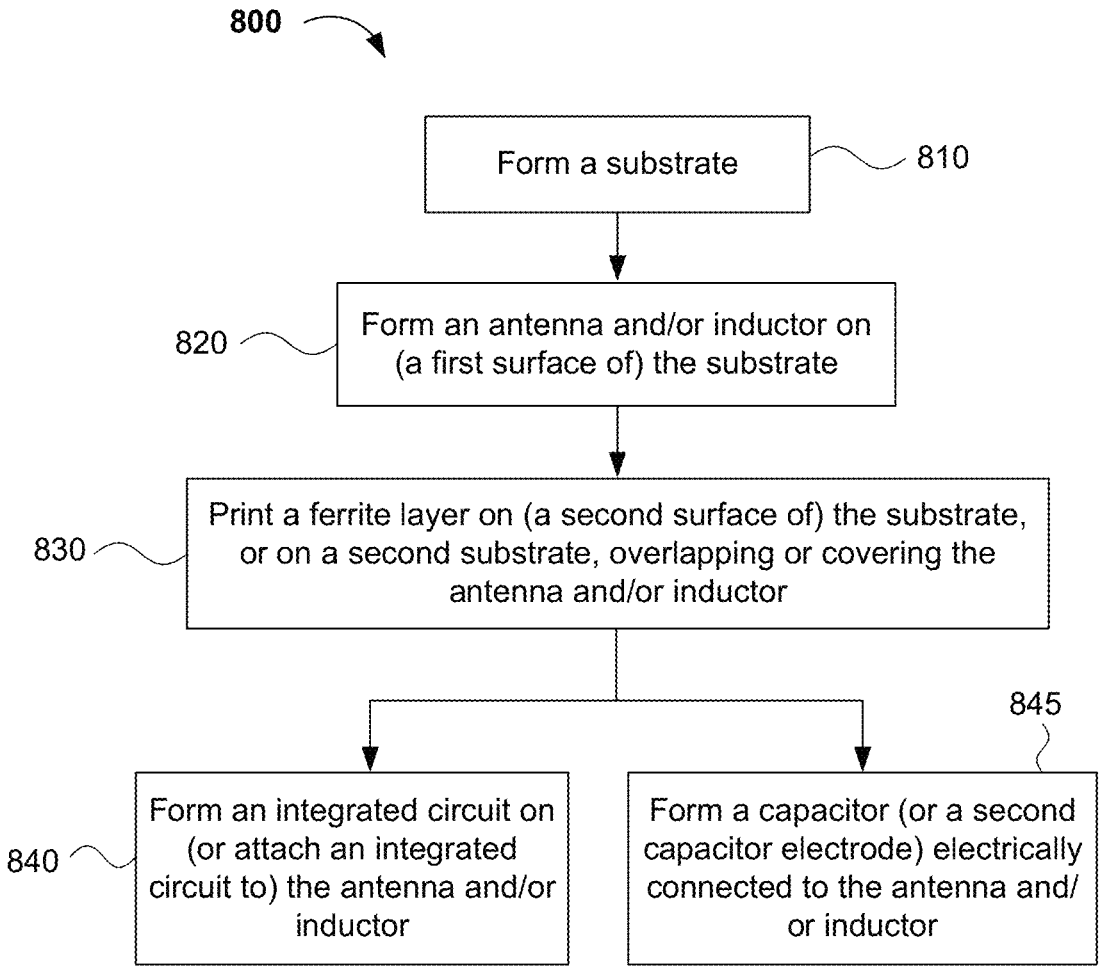
FIG. 10 is a flow chart illustrating an exemplary method of making the present integrated antenna/inductor and ferrite shield.

FIG. 10 is a flow chart 800 that shows an exemplary method of manufacturing a wireless communication device. Starting at 810, a substrate is formed or provided. In one or more embodiments, the substrate may comprise or consist of a plastic sheet or a metal foil. The method may further comprise forming a dielectric layer and/or barrier layer on the substrate (e.g., by coating or blanket deposition), as described herein.

At 820, an antenna and/or inductor is formed on the substrate. The antenna and/or inductor may be configured to receive and transmit or broadcast wireless signals. The received wireless signals may be at a first frequency. Wireless signals may be transmitted at a second frequency the same as or different from the first frequency. Forming the antenna and/or inductor may include depositing a first metal layer on a first surface of the substrate, and subsequently patterning (e.g., by photolithography) and etching the metal layer. Alternatively, the antenna and/or inductor may be formed by printing a metal coil or ring (or a seed layer therefor) on the substrate. Furthermore, the antenna/inductor and a capacitor (or an electrode or plate thereof) can be formed simultaneously. When the capacitor electrode or plate is formed with the antenna/inductor, the capacitor electrode or plate is generally formed at one end of the antenna/inductor. If a seed layer is printed, the method generally further comprises electroplating or electrolessly plating a bulk metal layer on the seed layer. The antenna and/or inductor may have a thickness of 0.01-2 mm, or any thickness or range of thicknesses therein.

At 830, a patterned ferrite layer is formed overlapping or covering the antenna. The ferrite layer may be formed on a second surface of the substrate opposite from the antenna, on the same side of the substrate over the antenna, or on a second substrate. The patterned ferrite layer mitigates or counteracts the electromagnetic effect(s) of a metal object on or near the wireless device (e.g., a surface of the wireless device nearest to the antenna), as described herein. When the ferrite layer is formed on the same side of the substrate over the antenna, the method may further comprise forming a dielectric layer on the antenna prior to forming the patterned ferrite layer. The patterned ferrite layer may be formed by printing or coating an ink or paste containing a ferrite or a ferrite precursor in a pattern on the substrate or dielectric layer. For example, the ferrite film may be printed using screen printing, stencil printing, inkjet printing, gravure printing, flexographic printing, stamp printing, or other conventional printing technique. Alternatively, the patterned ferrite layer may be coated on the substrate in a pattern by extrusion coating, spin-coating, painting, or spraying. When the patterned ferrite layer is formed on a second substrate, the second substrate may be placed on or over the first substrate by pick-and-place or roll-to-roll processing. Additionally and/or alternatively, the second substrate may be a disposable substrate (e.g., a silicone release paper having an adhesive layer). Thus, the second substrate may have favorable transferability properties. In some embodiments, the ferrite layer is coated or covered with an adhesive, and transferred onto the antenna substrate, on the side opposite from the antenna, or over the antenna. The pattern may have substantially the same shape as the antenna and substantially the same area of the antenna (e.g., from 1-10% greater area than the antenna). The patterned ferrite layer may be formed before or after forming the antenna.

Forming the patterned ferrite film may further comprise drying the ink or paste, and curing and/or annealing the patterned ferrite or ferrite precursor after drying the ink or paste. Drying the ink or paste may comprise merely allowing the ink or paste to dry at room or ambient temperature until most or substantially all of the solvent (when present) evaporates from the ferrite layer. Generally, this may take from 1 to 120 minutes, or until the layer is semi-glossy. When the film surface is dry (e.g., has a semi-glossy appearance), the film may be transferred to a curing apparatus. Furthermore, a magnetic field (e.g., magnets) may be applied during or prior to curing (e.g., using a hot plate with a magnetic or magnetizable surface) to densify the ferrite ink or paste and to maintain uniformity of the substrate(s) and ferrite films on the curing apparatus. In some embodiments, the magnetic field is applied at the point in time when an ink or paste has its lowest viscosity, which is generally immediately after printing or coating the ferrite ink or paste. To control particle orientation and/or to maintain uniformity in the ferrite layer, the magnetic field may have a field strength and uniformity and be applied in a manner that orients the ferrite particles in the ink or paste in one plane (e.g., parallel to the substrate). The time period to orient the particles may be relatively short when the ink or paste is coated or printed at a fast rate or speed, and/or when the ink or paste cools rapidly, so it is sometimes advantageous to apply the magnetic field to the ferrite ink or paste as soon as possible after printing or coating.

Curing conditions may range from 50-150° C. for 1-120 minutes (e.g., 120° C. for 10 minutes), as long as the conditions are compatible with the substrate material. Depending on the material of the antenna, the antenna may be protected prior to curing. For example, a copper antenna may be plated with silver to prevent oxidation of the antenna traces during the curing of the ferrite film. When the antenna traces comprise exposed aluminum, no additional plating steps are required to protect the antenna trace, since aluminum forms a self-limiting oxide. In embodiments in which the ferrite ink/paste is printed or coated onto a substrate other than the antenna substrate, the other substrate may have properties suitable for curing the ferrite (e.g., low or zero magnetic coercivity, high melting or glass transition temperature, etc.).

The methods for curing the ferrite layer may include heating using a furnace, a muffle oven, a UV lamp, a microwave oven, or a flash lamp. Curing may benefit from a further solvent evaporation period (when the ferrite layer is formed from an ink), in which the dried ferrite ink incubates at a temperature of at least room temperature (e.g., from 30° C. to 50° C.) while the solvent evaporates, or ramps from room temperature to the curing temperature over a predetermined time period (e.g., of from 1-30 minutes). The curing apparatus is heated to a temperature of at least 50 degrees ° C., preferably at least 150° C. (e.g., 80-250° C., or any range or value therein, such as 120° C.), and the film incubates therein for a predetermined period of time (e.g., 1-60 minutes or any value or range of values therein, such as 10 minutes) at the temperature of the curing apparatus. When the substrate can handle additional heat (e.g., it has a relatively high glass transition temperature, melting point, or recrystallization temperature), the curing temperature and/or time may be increased. At this point, the ferrite shielding film is fully dried, cured and adhered to the substrate. The thickness of the ferrite layer varies depending on the application and use, but is typically within the range of 50-700 microns. The coating may be relatively thick (e.g., 1 mm), especially when heating at higher temperatures, such as 150° C. Generally, when the ferrite composition (without a solvent) is extruded onto the substrate or dielectric film, drying and curing may not be necessary, although additional heating (e.g., to densify the ferrite, or in the case of a stainless steel substrate, to burn off the polymer binder in an oxidizing atmosphere) may be beneficial.

The patterned ferrite films may have a thickness in a range from about 50 μm to 700 μm (e.g., 60-600 μm, 100-500 μm, or any value or range of values therein), and a permeability of approximately 5-25 $H \cdot m^{-1}$ or $N \cdot A^{-2}$. Typically, ferrite powders having higher permeabilities provide more effective shields.

By forming a patterned ferrite layer or film directly onto the same substrate as the antenna, or otherwise over or covering just the area of the antenna, a ferrite shield may be fabricated that covers only the locations required for shielding, without sacrificing read range performance. As a result, the cost of the materials for making the EMI shield may be reduced substantially. In addition, the present method eliminates any requirement for an adhesive layer, thus eliminating the cost of such a layer and further reducing the cost of the shield.

At 840, an integrated circuit may be formed on or over the antenna, or attached to the antenna. When the integrated circuit is formed on or over the antenna, the method may comprise first forming a dielectric layer (which may be planarized or reflowed) over the antenna in the area of the integrated circuit other than over the ends of the antenna, and pads or plugs may be formed in the openings in the dielectric layer exposing the ends of the antenna before the integrated circuit is formed. Each layer of the integrated circuit may be formed on the previously formed layer(s) by thin film deposition and patterning techniques or printing. The circuitry in the wireless and/or near field communication (NFC) device may include a transmitter (e.g., modulator), a receiver (e.g., demodulator), and a rectifier (e.g., coupled or connected to the antenna), a clock generator and/or clock recovery circuit (e.g., configured to receive the first signal from the receiver), a memory configured to store and/or output data (e.g., an identification code or number), a sensor, a battery, etc. The antenna is generally coupled to the receiver (e.g., demodulator) and the transmitter (e.g., modulator). In general, the receiver and/or transmitter are part of the integrated circuit that is attached to the antenna. For examples of such integrated circuits and antennas, see, U.S. patent application Ser. No. 12/625,439, filed on Nov. 24, 2009, which related portions are incorporated by reference. The electrical connection between the integrated circuit and the antenna may occur before or after forming the patterned ferrite layer on the substrate.

Alternatively, the antenna may be formed on or over the integrated circuitry, or attached to the integrated circuitry. In such embodiments, the ferrite layer may be formed on or over the substrate, as described herein. A dielectric layer may be formed on the patterned ferrite before the antenna is formed, when the antenna is formed over the patterned ferrite layer. Forming the antenna may include depositing a metal layer on the dielectric layer, then patterning and etching the metal layer, or printing a metal coil or ring on the dielectric layer. At 845, the capacitor (or the second capacitor electrode or plate) is formed in electrical contact with the antenna and/or inductor. When the second capacitor electrode or plate is formed, it may be formed on or over a dielectric layer that is, in turn, formed on or over the first capacitor electrode or plate. The second capacitor electrode or plate is generally formed at a second end of the antenna and/or inductor.

Forming the patterned ferrite layer (e.g., a 100 μm thick layer in a roll form) may include additional or alternative methods. For example, to form a relatively thin ferrite layer, a coating or vacuum-based coating process may be used, and the thin ferrite layer can be patterned after its formation on the wireless device. Alternatively, the patterned ferrite layer may be formed from a solution-based ink or a composition including 100% solid materials (e.g., materials that are in the solid phase at ambient temperatures).

Solution-based methods of producing the patterned ferrite layer may include forming a coating layer thicker than 100 μm and then drying it. During such a process, the loss of volatile components, such as water and/or an organic solvent, may occur. When using a material that is highly loaded with a pigment (e.g., containing>90% by weight of the ferrite powder), the last portion of (or residual) volatile components may have difficulty escaping the coating, since their diffusion path may be blocked or diverted by the pigment particles. As a result, 100% solid-based compositions may be desirable. Examples of 100% solid-based compositions include, but are not limited to, compositions including a plastisol, an ultraviolet (UV)-curable coating, hot-melt coatings, and heat-set cross-linking binder systems.

In some cases, plastisols may not be suitable for highly-filled coatings, since they start as a dispersion of solid binder particles in plasticizer. Adding a large proportion of pigment particles (e.g., the ferrite powder in a ratio of 9:1 or greater) to the dispersion may not result in an easily coatable composition.

With high ferrite loading, some of the UV-curable components in a coating composition may not be reached directly by UV radiation. Thus, some UV-curable coatings may include one or more components that, when the curing (e.g., cross-linking) reaction is triggered by UV radiation, can propagate curing through the coating (e.g., an epoxide or cyclic ester or anhydride), even in the absence of further UV exposure. Heat-set cross-linking binder systems may be similar to UV-cured coatings. The heat-set cross-linking binder systems include one or more liquids including reactive groups (e.g., chemical functional groups that react with each other at a certain minimum temperature and optionally at a certain minimum viscosity). Generally, the liquid(s) in a heat-set cross-linking binder system are low-viscosity. Typically, the reactive groups are not triggered by UV radiation, but rather become reactive when a threshold temperature is reached. Thus, heat-set cross-linking binder systems may overcome curing and/or exposure issues with UV-cured coatings.

Additionally or alternatively, other processes may be used to form the patterned ferrite layer. For example, extrusion can be used to produce plastic films. The desired thickness of the sheet or roll may be produced by direct extrusion from an extruder such as a twin-screw extruder. For example, in further exemplary embodiments, a hot-melt coating can be used in cases where a UV-curable composition has curing issues. Hot-melt coatings include a binder system (e.g., one or more polymer binders) that are able to melt at a reasonable processing temperature (e.g., a temperature below which the ferrite undergoes morphological or ferroelectric changes), and hence provide sufficient flow to form the patterned ferrite layer. Only heat has to be removed or extracted from a hot-melt coating, as opposed to volatile components.

Forming the ferrite shields using a hot-melt coating composition may comprise or consist of two processes (not including the conversion stages). First, a mixing process combines the ferrite powder and the binder at a molten stage (e.g., at a temperature of 100-300° C., depending on the softening and/or melting temperature of the binder) to produce a uniform mix. The ferrite powder may be separated or broken up into small particles if they have formed agglomerates. Generally, air is excluded, which by necessity is included in or entrained with the raw materials as they are added to the mixing process. In various embodiments, a suitable continuous process is twin-screw extrusion, which allows multi-stage temperature control and mixing. The output from this stage is pellets or granules of the mixed raw materials, which may be cooled to room temperature before subsequent use. Any unused or scrap material from later stages, such as holes or cut-outs, may be incorporated into this mixture. As a result, waste and raw material costs may be reduced or minimized.

The second process is the hot-melt coating itself. In exemplary embodiments, the composition (e.g., ferrite particles in the binder) is heated to at least a temperature at which the composition can be extruded, and a layer of the heated composition is coated onto a disposable substrate, such as siliconized paper, using a roll-to-roll (R2R) machine. In one example, the layer has a thickness of 200 μm. In a further example, a slot-die coating method may be used to coat the layer of the heated composition onto the substrate. Other hot-melt coating methods, such as reverse roll or gap-coating methods, may be used as well.

During processing of the molten composition, the viscosity of the composition may be outside the range in which facile processing occurs. For example, the hot-melt coating has an upper viscosity limit for a given hardware set-up. As a result, the hot-melt coating has to remain below that upper limit. Higher percentages of ferrite in the mixture produce higher viscosities, so lowering the ferrite content reduces the viscosity. However, lowering the percentage of ferrite also reduces shielding performance.

In order to lower the melt viscosity, a second component may be introduced into the binder system. For example, the second component may include a wax. In various examples, the component may be a natural wax having a high melting point (e.g., a Carnauba wax having a melting point of approximately 80° C.). Generally, waxes have relatively abrupt melting points, as compared with polymers. Furthermore, waxes are solid below their melting points, which adds strength to the binder system. However, a wax lowers the viscosity of the hot-melt composition abruptly when the composition is heated above the melting point of the wax. In addition, waxes can generally be removed fairly easily using conventional techniques (e.g., ashing [for example, in addition to or at the same time as the ferrite is sintered], cleaning with one or more organic solvents, etc.).

In one example, a 50:50 mix of a wax (e.g., Carnauba wax) and the polymer (e.g., EVA) by weight produces relatively good results when the ferrite powder is present in a proportion by weight in the composition of approximately 70-80%. In exemplary embodiments, a recipe of approximately 75% ferrite, 12.5% EVA, and 12.5% wax by weight provides good results. In addition, additives may be added to improve flow and help heat-stabilize the other constituents.

The hot-melt extruder may comprise a melt tank. The melt tank heats the hot-melt composition before it flows to a gear pump and is pumped to the extrusion die. However, higher-viscosity compositions may not flow readily to the gear pump. A single-screw extruder that melts the granules and simultaneously forces them to the extrusion die may be useful for higher-viscosity compositions. However, given that (1) the initial output before cooling of a twin-screw extruder is a molten mix and (2) the intermediate product after melting of the hot-melt process is the same molten mix, the twin screw-extruder may carry out the mixing process by connecting it to the hot melt extrusion die that performs the coating process.

Alternatively, the output of the mixing process may be a thermoplastic pellet. This form of material is widely used in a range of processes, such as injection molding, coining, etc., in the plastics industry. Such processes involving thermoplastic pellets may replace a hot-melt coating process to produce the ferrite shields or to place an individual ferrite shield on a roll.

Furthermore, a coating method capable of producing patterned coatings may be used to place the desired pattern of the ferrite shield directly onto the target antenna, or on a substrate (e.g., a removable or peelable substrate) for subsequent placement on the antenna. The input to such coating method may be the pellets output from the mixing process.

The above processes may also produce a semi-finished product. For instance, a relatively thick coating may be produced using the extruder or hot-melt coater. The coating may be calendered down (e.g., pressed through rollers) or otherwise have its thickness reduced to the desired thickness (e.g., 100 μm). Alternatively, a coining process (e.g., precision stamping) may be used to obtain the desired thickness of the patterned ferrite layer. Such processes advantageously provide a greater thickness accuracy and/or fewer voids in the coating. Generally, the present device has a low, but finite, percentage of voids (e.g., from 1-10% by volume, or any value or range of values therein).

CONCLUSION/SUMMARY

The present invention advantageously provides a method for applying a patterned electromagnetic shield (e.g., ferrite film) onto an NFC, EAS or RF antenna, or printing the electromagnetic shield onto the same substrate as an antenna, which can counteract the electromagnetic effect(s) of nearby metal surfaces on the antenna. In addition, the present invention minimizes the cost of manufacturing wireless communication devices by printing shielding material only where it is required (e.g., in locations of the antenna rings and/or loops), while still providing sufficient shielding, such that the tags may be read at a reasonable distance (e.g., 5-15 mm or more). Furthermore, the present invention eliminates the necessity of an additional adhesive, since the patterned ferrite film adheres onto the antenna substrate directly. The present invention further advantageously provides ferrite-containing films that have sufficient flexibility for application onto products having relatively small radii.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application. It is intended that the scope of the invention be defined by the claims appended hereto and their equivalents.

What is claimed is:

1. A wireless communication device, comprising:

a) a substrate with an antenna and/or inductor thereon;

b) a patterned ferrite layer having a pattern that is substantially identical to and/or defined by a pattern of the antenna and/or inductor, the patterned ferrite layer overlapping said antenna and/or inductor entirely or to a degree that provides a same shielding of said antenna and/or inductor as an otherwise identical blanket ferrite film; and c) a capacitor electrically connected to said antenna and/or inductor.

2. The device of claim 1, further comprising an integrated circuit.

3. The device of claim 2, wherein:

a) the integrated circuit comprises a receiver configured to convert a first wireless signal to an electric signal and a transmitter configured to generate a second wireless signal; and b) the antenna and/or inductor comprises the antenna, which is configured to receive said first wireless signal and transmit or broadcast said second wireless signal.

4. The device of claim 1, wherein said substrate comprises a glass, a glass/polymer laminate, a high temperature polymer, or a metal foil.

5. The device of claim 4, wherein said substrate is a flexible substrate.

6. The device of claim 1, wherein said antenna and/or inductor is on a first surface of the substrate, and the patterned ferrite layer is on a second surface of the substrate.

7. The device of claim 1, wherein the patterned ferrite layer is configured to mitigate or counteract an electromagnetic effect of metal on or near a surface of said wireless device.

8. The device of claim 1, wherein said patterned ferrite layer comprises a magnetically soft ferrite.

9. The device of claim 1, wherein the pattern of the patterned ferrite layer is substantially identical to the pattern of the antenna and/or inductor, and has an area that (i) overlaps at least 90% of an area of the antenna and/or inductor and (ii) is less than or equal to 200% of the area of the antenna and/or inductor.

10. The device of claim 1, wherein the pattern of the antenna and/or inductor has an outermost periphery and an innermost periphery, and the pattern of the ferrite layer has an outermost periphery and an innermost periphery that is substantially identical to and/or defined by the outermost periphery and the innermost periphery of the pattern of the antenna and/or inductor.

11. The device of claim 1, wherein the patterned ferrite layer has a thickness of from 50 μm to 700 μm and a permeability of about 5-25 $H \cdot m^{-1}$ or $N \cdot A^{-2}$.

12. A method of manufacturing a wireless communication device, comprising:

a) forming an antenna and/or inductor on a substrate, said antenna and/or inductor being configured to (i) generate or produce a current in the device sufficient for the device to backscatter detectable electromagnetic radiation in the presence of an oscillating wireless signal having a predetermined frequency, or (ii) receive a first wireless signal and/or transmit or broadcast a second wireless signal; and b) forming a patterned ferrite layer overlapping said antenna and/or inductor entirely or to a degree that provides the same shielding of said antenna and/or inductor as an otherwise identical blanket ferrite film, the patterned ferrite layer having a pattern that is substantially identical to and/or defined by a pattern of the antenna and/or inductor.

13. The method of claim 12, comprising forming said antenna on said substrate, said antenna being configured to receive said first wireless signal and transmit or broadcast said second wireless signal, and the method further comprising electrically connecting an integrated circuit and said antenna.

14. The method of claim 13, wherein the integrated circuit comprises a receiver configured to convert said first wireless signal to an electric signal and a transmitter configured to generate said second wireless signal.

15. The method of claim 12, wherein said patterned ferrite layer is formed from a hot melt containing a ferrite or a ferrite precursor.

16. The method of claim 12, wherein forming said patterned ferrite layer comprises printing an ink or paste containing said ferrite or said ferrite precursor on (i) a side of said substrate opposite from said antenna and/or inductor, or (ii) a same side of said substrate as said antenna and/or inductor, wherein a dielectric layer is between said patterned ferrite layer and said antenna and/or inductor.

17. The method of claim 16, further comprising drying and curing said ferrite-containing ink.

18. The method of claim 12, wherein forming said patterned ferrite layer comprises printing a composition containing a ferrite or ferrite precursor and a polymer binder, the composition consisting of components that are in the solid phase at 25° C., on (i) a side of said substrate opposite from said antenna and/or inductor, or (ii) a same side of said substrate as said antenna and/or inductor, wherein a dielectric layer is between said patterned ferrite layer and said antenna.

19. The method of claim 12, wherein the pattern of the ferrite layer is substantially identical to the pattern of the antenna and/or inductor, and has an area that (i) overlaps at least 90% of an area of the antenna and/or inductor and (ii) is less than or equal to 200% of the area of the antenna and/or inductor.

20. The method of claim 12, wherein the pattern of the antenna and/or inductor has an outermost periphery and an innermost periphery, and the pattern of the ferrite layer has an outermost periphery and an innermost periphery that is substantially identical to and/or defined by the outermost periphery and the innermost periphery of the antenna and/or inductor.

* * * * *